US010976100B2

(12) United States Patent
Seo et al.

(10) Patent No.: US 10,976,100 B2
(45) Date of Patent: Apr. 13, 2021

(54) REFRIGERATOR

(71) Applicant: Samsung Electronics Co., Ltd., Suwon-si (KR)

(72) Inventors: Jun Won Seo, Hwaseong-si (KR); Jea Won Lee, Hwaseong-si (KR); Yong Soo Kyong, Yongin-si (KR); Kyung Ho Hwang, Anyang-si (KR); Jae Bok Lee, Seongnam-si (KR); Myoung Jin Jang, Hwaseong-si (KR); Nam Gu Choi, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/787,998

(22) Filed: Feb. 11, 2020

(65) Prior Publication Data

US 2020/0173713 A1 Jun. 4, 2020

Related U.S. Application Data

(63) Continuation of application No. 15/855,881, filed on Dec. 27, 2017, now Pat. No. 10,591,204.

(30) Foreign Application Priority Data

Dec. 29, 2016 (KR) ..... 10-2016-0182918

(51) Int. Cl.
*F25D 25/00* (2006.01)
*F25D 25/02* (2006.01)
(Continued)

(52) U.S. Cl.
CPC ..... *F25D 25/025* (2013.01); *F25D 23/021* (2013.01); *F25D 23/067* (2013.01); *F25D 29/005* (2013.01)

(58) Field of Classification Search
CPC .... F25D 23/021; F25D 23/067; F25D 23/087; F25D 23/028; F25D 25/025; F25D 29/005; A47B 88/493; A47B 88/487; A47B 88/75
(Continued)

(56) References Cited

U.S. PATENT DOCUMENTS 8,157,338 B2 4/2012 Seo et al.
8,162,422 B2 4/2012 Kim
(Continued)

FOREIGN PATENT DOCUMENTS

DE 4445319 A1 6/1996
DE 29701427 U1 3/1997
(Continued)

OTHER PUBLICATIONS

ISA/KR, "International Search Report," International Application No. PCT/KR2017/015601, dated Apr. 24, 2018, 4 pages.
(Continued)

*Primary Examiner* — Janet M Wilkens

(57) ABSTRACT

A refrigerator includes a body, a storage compartment formed inside the body, a plurality of drawers provided inside the storage compartment, a door slidably provided to open and close the storage compartment and a selective drawing device configured to select a first drawer from among the plurality of drawers and to draw the first drawer together with the door. The desired drawer can be pulled out together with the door at the time of pulling out the door, so that the usability can be improved.

8 Claims, 27 Drawing Sheets

(51) Int. Cl.
*F25D 23/06* (2006.01)
*F25D 23/02* (2006.01)
*F25D 29/00* (2006.01)

(58) Field of Classification Search
USPC .... 312/402, 404, 401, 330.1, 334.7, 334.12, 312/350, 301, 308, 334.8
See application file for complete search history.

(56) References Cited

U.S. PATENT DOCUMENTS

| | | | | |
|---|---|---|---|---|
| 10,551,113 | B1 * | 2/2020 | Wantland | A47B 88/477 |
| 10,591,204 | B2 * | 3/2020 | Seo | F25D 23/021 |
| 2004/0164654 | A1 | 8/2004 | Laible | |
| 2006/0049731 | A1 | 3/2006 | Choi et al. | |
| 2007/0245762 | A1 | 10/2007 | Maglinger et al. | |
| 2008/0203875 | A1 * | 8/2008 | Lim | F25D 23/021 312/404 |
| 2010/0162745 | A1 | 7/2010 | Kim | |
| 2010/0219730 | A1 | 9/2010 | Watts et al. | |
| 2011/0006655 | A1 | 1/2011 | Seo et al. | |
| 2011/0016908 | A1 | 1/2011 | Kim | |
| 2013/0270989 | A1 | 10/2013 | Park et al. | |
| 2014/0265805 | A1 | 9/2014 | Chamberlin | |
| 2015/0028735 | A1 | 1/2015 | Nam et al. | |
| 2016/0209107 | A1 | 7/2016 | Choi et al. | |
| 2018/0100690 | A1 * | 4/2018 | Gatter | A47B 88/437 |

FOREIGN PATENT DOCUMENTS

| | | | |
|---|---|---|---|
| DE | 102005042145 | A1 | 3/2006 |
| DE | 102011100713 | A1 | 11/2012 |
| EP | 2273219 | A2 | 1/2011 |
| JP | H0445382 | A | 2/1992 |
| JP | 2001349665 | A | 12/2001 |
| JP | 2006141797 | A | 6/2006 |
| JP | 2008196745 | A | 8/2008 |
| JP | 2010014341 | A | 1/2010 |
| KR | 10-2005-0017603 | A | 2/2005 |
| KR | 20080095355 | A | 10/2008 |
| KR | 20110010405 | A | 2/2011 |
| KR | 20140048619 | A | 4/2014 |
| KR | 20160023741 | A | 3/2016 |
| WO | 2009/083348 | A2 | 7/2009 |

OTHER PUBLICATIONS

Supplementary European Search Report dated Oct. 21, 2019 in connection with European Patent Application No. 17 88 8528, 7 pages.

* cited by examiner

REFRIGERATOR

CROSS-REFERENCE TO RELATED APPLICATION

The present application is a continuation of U.S. patent application Ser. No. 15/855,881 filed on Dec. 27, 2017, which is based on and claims priority to Korean Patent Application No. 10-2016-0182918 filed on Dec. 29, 2016, the disclosures of which are herein incorporated by reference in their entirety.

TECHNICAL FIELD

Embodiments of the present disclosure relate to a refrigerator in which one drawer can be selected from among a plurality of drawers when a door is drawn, so that the drawer and the door can be drawn together.

BACKGROUND

A refrigerator is a home appliance that keeps food fresh by including a body in which a storage compartment is formed, a cold air supplying device for supplying cold air to the storage compartment, and a door configured to open/close the storage compartment.

Drawers configured to accommodate food may be provided in the storage compartment, and the drawers may be drawn or inserted together with the door. When a plurality of drawers are provided in the storage compartment, lower drawers therefrom are generally drawn or inserted together with the door, and upper drawers therefrom are generally drawn or inserted manually by a user.

Thus, when the user wants to draw an upper drawer, the user has to draw the door and then has to grasp and draw the upper drawer manually.

SUMMARY

To address the above-discussed deficiencies, it is a primary object to provide a refrigerator in which one drawer can be selected from among a plurality of drawers and can be drawn together with a door.

It is another aspect of the present disclosure to provide a refrigerator in which each of a door and a plurality of drawers is independently slidable so that a selective drawn operation can be performed.

Additional aspects of the disclosure will be set forth in part in the description which follows and, in part, will be obvious from the description, or may be learned by practice of the disclosure.

In accordance with one aspect of the present disclosure, a refrigerator includes a body; a storage compartment formed inside the body; a plurality of drawers provided inside the storage compartment; a door slidably provided to open and close the storage compartment; and a selective drawing device configured to select a first drawer from among the plurality of drawers and to draw the first drawer together with the door.

The selective drawing device may include a switch being operable to select a drawer to be drawn from among the plurality of drawers; and a selector configured to connect the selected door from among the plurality of drawers according to manipulation of the switch, to the door.

The switch may be provided in an approachable position in a state in which the door is closed.

The door may include a handle portion that can be gripped to open and close the door, and the switch is provided in the handle portion.

The selector may be rotatably provided at a rear surface of the door.

Each of the plurality of drawers may include a connector into which the selector is inserted and to which the selector is connected.

The selective drawing device may include a power transmission unit configured to transmit manipulation force of the switch to the selector.

The power transmission unit may include an intermediate rotation body that rotates according to a rectilinear motion of the switch and a connection rod configured to connect the intermediate rotation body to the selector in a manner to rotate the selector according to rotation of the intermediate rotation body.

The switch may include a rack gear portion, and the power transmission unit may include a pinion engaged with the rack gear portion and rotating, and a wire member configured to transmit rotational force of the pinion to the selector.

The power transmission unit may include a lever member being rotatable around a rotation shaft in a manner to rotate the intermediate rotation body according to a rectilinear motion of the switch and a slide member that makes a rectilinear motion according to a rotational motion of the lever member.

The door may include a rear panel that constitutes a rear surface of the door, and a connection opening through which the switch and the selector are connected to each other, is formed in the rear panel.

The refrigerator may further include a door rail assembly configured to support the door slidably; a first drawer roller provided at a first drawer from among the plurality of drawers and supported on the door rail assembly; and a second drawer roller provided at a second drawer from among the plurality of drawers and supported on the door rail assembly.

The refrigerator may further include a door rail assembly configured to support the door slidably; a drawer rail assembly configured to support a first drawer from among the plurality of drawers slidably; and a roller provided at a second drawer from among the plurality of drawers and supported on the door rail assembly.

The refrigerator may further include a door rail assembly configured to support the door slidably; a first drawer rail assembly configured to support a first drawer from among the plurality of drawers slidably; and a second drawer rail assembly configured to support a second drawer from among the plurality of drawers slidably.

The refrigerator may further include, when the first drawer from among the plurality of drawers is drawn together with the door, a stopper configured to fix a second drawer from among the plurality of drawers not to be drawn.

In accordance with another aspect of the present disclosure, a refrigerator include a body; a storage compartment formed inside the body; a drawer provided inside the storage compartment; a door slidably provided to open and close the storage compartment; a door rail assembly configured to support the door slidably; and a guide rib provided in sidewalls of the body to guide movement of the drawer, wherein the drawer includes a front roller supported on the door rail assembly and a rear roller supported on the guide rib.

The door rail assembly may include a fixed rail fixed to the body and a moving rail. The moving rail may be fixed to the door and being slidable with respect to the fixed rail, and the moving rail may include a roller support configured to support the front roller.

The refrigerator may further include a selective drawing device configured to connect the door to the drawer in a manner to draw the drawer together with the door when the door is drawn, or configured to separate the door from the drawer so that only the door is drawn.

The guide rib may include a stopper configured to keep a position of the drawer when the door is drawn in a state in which the door and the drawer are separated from each other.

In accordance with one aspect of the present disclosure, a refrigerator includes a body; a storage compartment formed inside the body; a drawer provided inside the storage compartment; a door slidably provided to open and close the storage compartment; and a selective drawing device configured to connect the door to the drawer in a manner to draw the drawer together with the door when the door is drawn, or configured to separate the door from the drawer so that only the door is drawn, wherein the selective drawing device includes: a switch provided in an approachable position in a state in which the door is closed and configured to select a drawer to be drawn together with the door; and a selector configured, according to manipulation of the switch, to connect the drawer to the door or to separate the drawer from the door.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 18 illustrates a state in which a door is closed, and FIG. 19 illustrates a state in which, when the door is drawn, an upper drawer is drawn together, and FIG. 20 illustrates a state in which, when the door is drawn, a lower drawer is drawn together;

FIG. 22 illustrates a state in which a door is closed, and FIG. 23 illustrates a state in which an upper drawer is drawn together when the door is drawn, and FIG. 24 illustrates a state in which a lower drawer is drawn together when the door is drawn; FIG. 25 illustrates a state in which a door is closed, and FIG. 26 illustrates a state in which an upper drawer is drawn together when the door is drawn, and FIG. 27 illustrates a state in which a lower drawer is drawn together when the door is drawn.

DETAILED DESCRIPTION

FIGS. 1 through 27, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the present specification are just exemplary embodiments of the present disclosure and do not represent the technical concept of the present disclosure. Thus, it should be understood that various equivalents or modifications that may replace the embodiments at the time of filing the present application are included in a scope of a right of the present disclosure.

Hereinafter, exemplary embodiments of the present disclosure will be described in detail with reference to the attached drawings.

Figure 1:
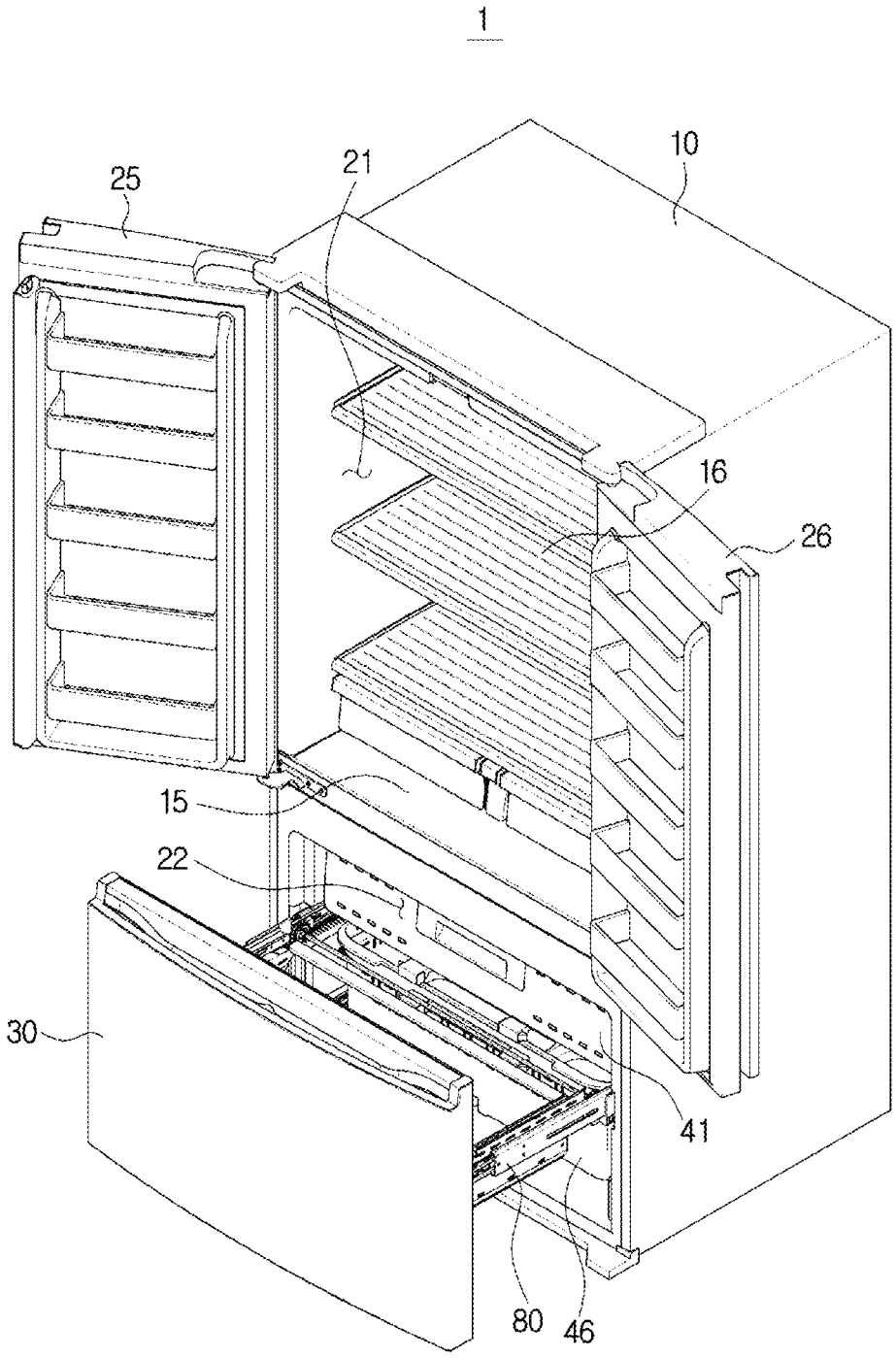
FIG. 1 is a view of a refrigerator according to an embodiment of the present disclosure.
Figure 2:
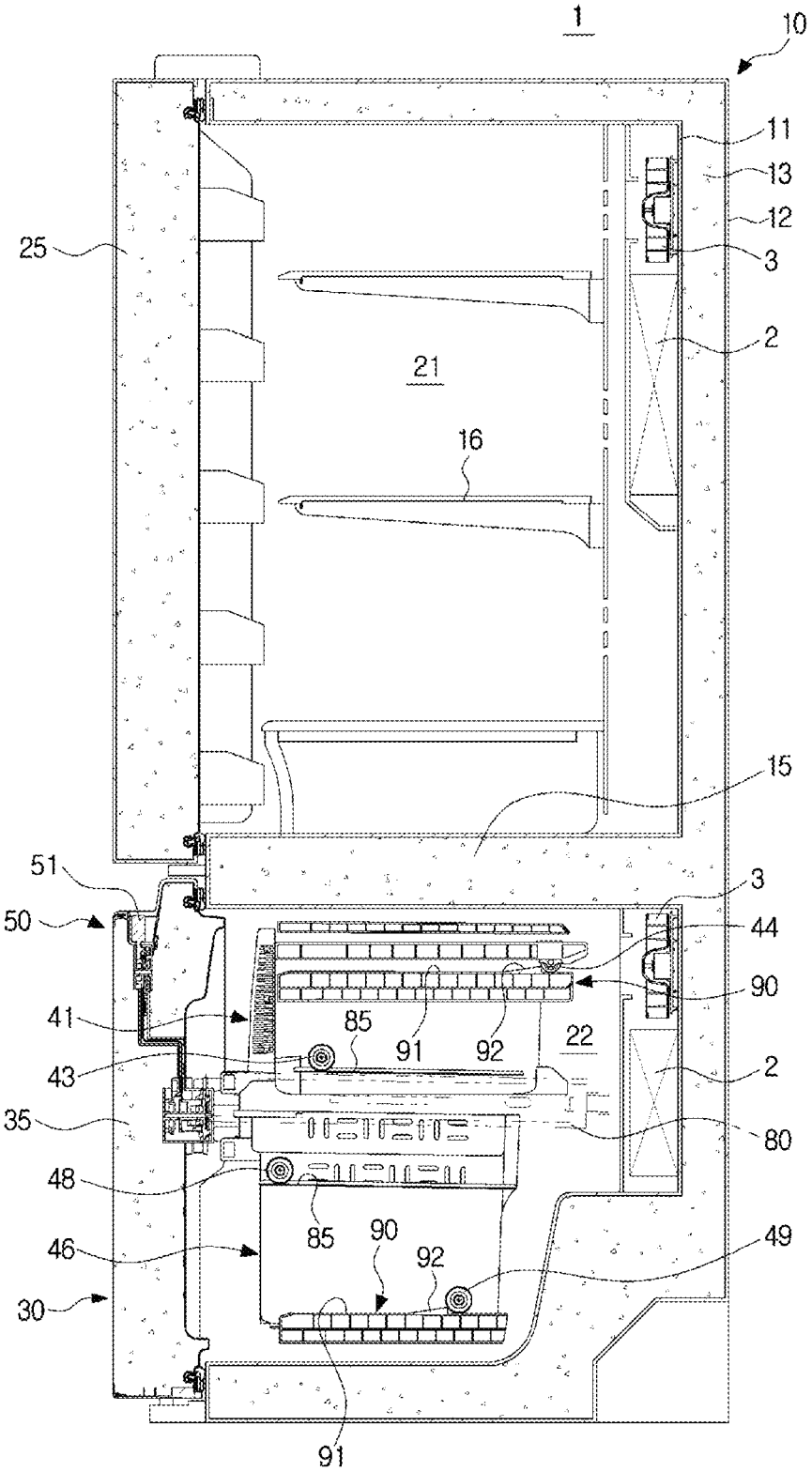
FIG. 2 is a side cross-sectional view schematically illustrating a main configuration of the refrigerator of FIG. 1.
Figure 3:
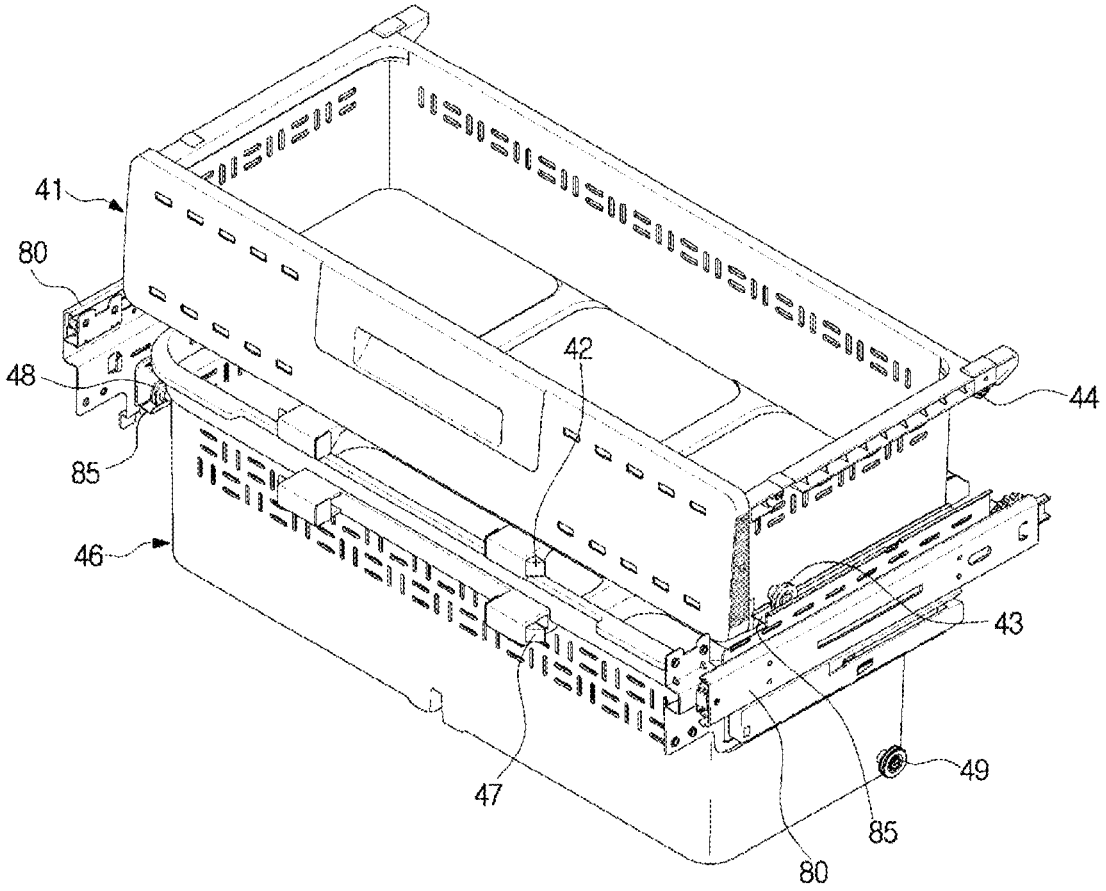
FIG. 3 is a view of an upper drawer and a lower drawer of the refrigerator of FIG. 1.
Figure 4:
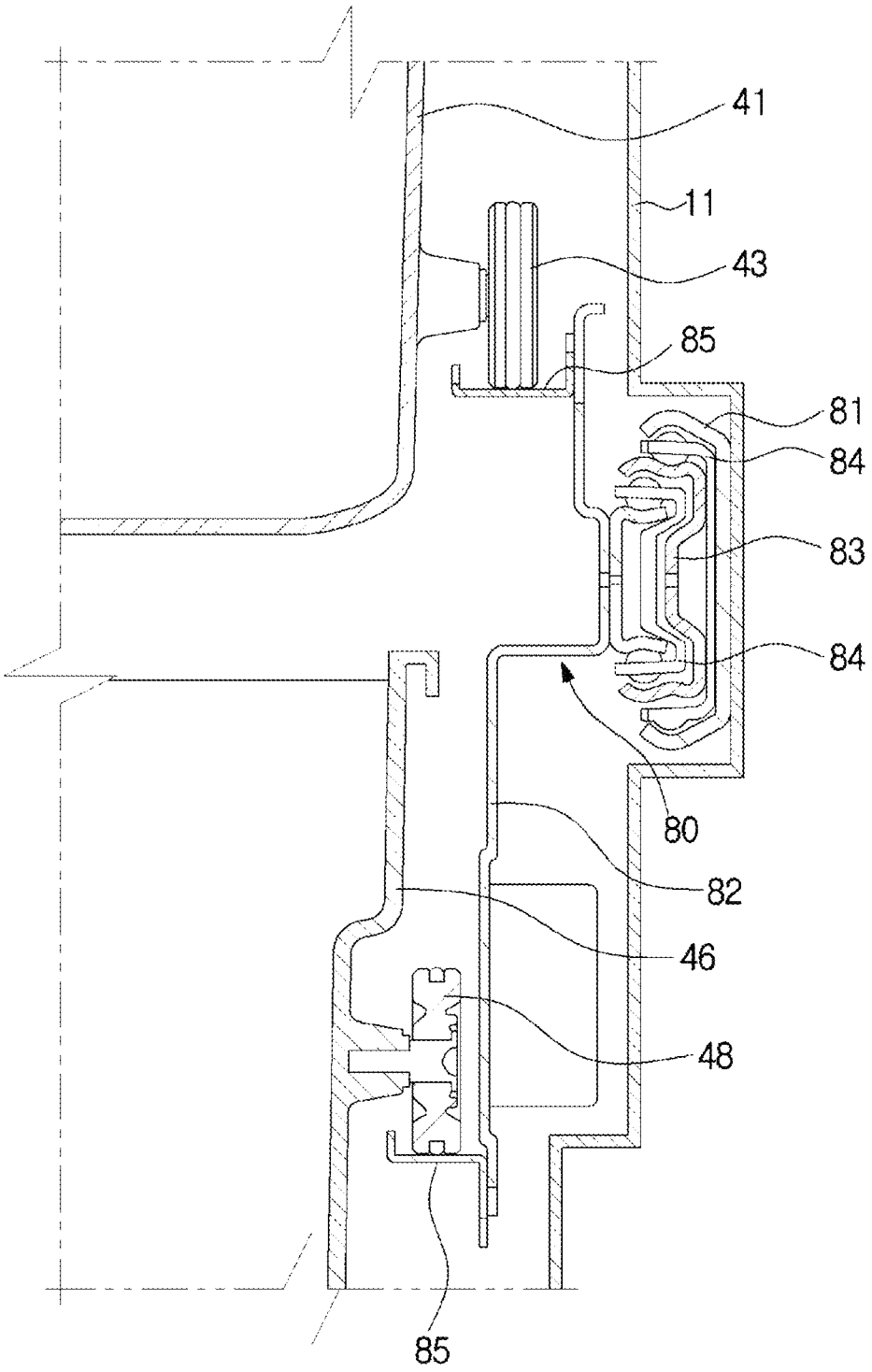
FIG. 4 is a view of a door rail assembly of the refrigerator of FIG. 1.

FIG. 1 is a view of a refrigerator according to an embodiment of the present disclosure. FIG. 2 is a side cross-sectional view schematically illustrating a main configuration of the refrigerator of FIG. 1. FIG. 3 is a view of an upper drawer and a lower drawer of the refrigerator of FIG. 1. FIG. 4 is a view of a door rail assembly of the refrigerator of FIG.

Figure 5:
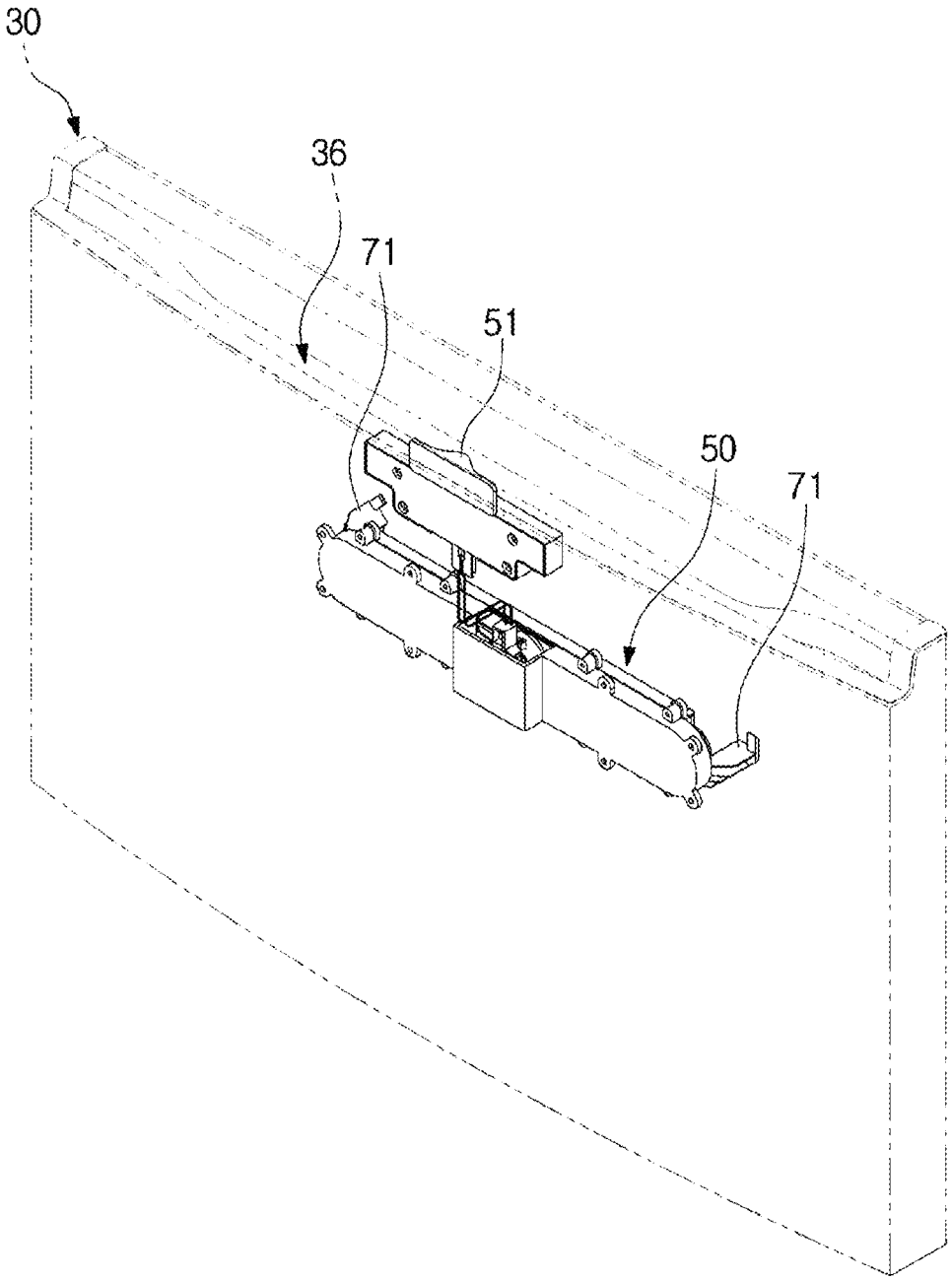
FIG. 5 is a perspective view of a door of the refrigerator of FIG. 1.
Figure 6:
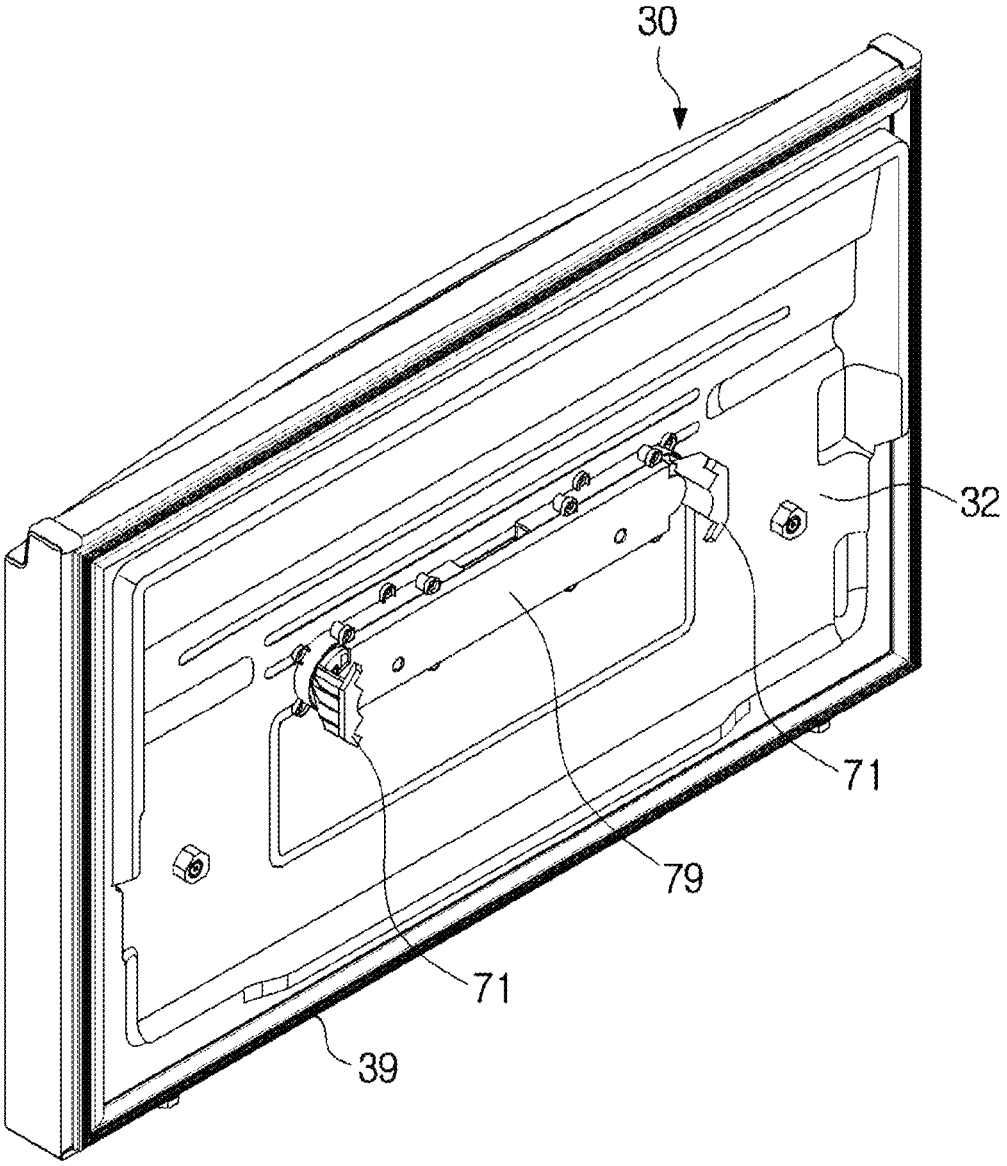
FIG. 6 is a rear perspective view of the door of the refrigerator of FIG. 1.

1. FIG. 5 is a perspective view of a door of the refrigerator of FIG. 1. FIG. 6 is a rear perspective view of the door of the refrigerator of FIG. 1.

Referring to FIGS. 1 through 6, a refrigerator 1 may include a body 10, storage compartments 21 and 22, which are formed inside the body 10 so as to store food, a cold air supplying device disposed to supply cold air to the storage compartments 21 and 22, and doors 25, 26, and 30 configured to open/close the storage compartments 21 and 22.

The body 10 may have an approximately box shape with an opened front side. The body 10 may include an inner case 11, an outer case 12 coupled to an outside of the inner case 11, and an insulating material 13 disposed between the inner case 11 and the outer case 12.

The inner case 11 may be formed of an injected plastic material. The storage compartments 21 and 22 may be formed inside the inner case 11. The outer case 12 may be formed of a metal material. The insulating material 13 may include an urethane foam insulation or a vacuum insulation.

The cold air supplying device may generate cold air using evaporation latent heat of a refrigerant and may supply the cold air to the storage compartments 21 and 22. The cold air supplying device may include a compressor, a condenser, an expansion device, an evaporator 2, and a blower fan 3.

The storage compartments 21 and 22 may be partitioned into upper and lower storage compartments by an intermediate partition wall 15 of the body 10. The upper storage compartment 21 may be kept at about 0° C. to 5° C. and may be used as a refrigerator compartment for keeping food refrigerated, and the lower storage compartment 22 may be kept at about −30° C. to 0° C. and may be used as a freezer compartment for keeping food frozen. The refrigerator compartment 21 and the freezer compartment 22 may include shelves 16 on which food may be put, and drawers 41 and 46 configured to store food and slidable in a forward/backward direction.

The drawers 41 and 46 may be provided so that top surfaces thereof may be drawn so as to take out food from or put food into the drawers 41 and 46. The drawers 41 and 46 may be disposed in a vertical direction. The drawers 41 and 46 may be drawn together when a freezer compartment door 30 that will be described later is drawn. In particular, one drawer may be selected from among the plurality of drawers 41 and 46 by using a selective drawing device 50 that will be described later and may be drawn together with the freezer compartment door 30. The drawers 41 and 46 may include connectors 42 and 47, respectively, so as to be connected to the selective drawing device 50. When the freezer compartment door 30 is drawn, connection protrusions 74 and 75 of a selector 71 that will be described later are caught in the connectors 42 and 47 so that an upper drawer 41 or a lower drawer 46 can be drawn.

The drawers 41 and 46 may have rollers 43, 44, 48, and 49 configured to support loads of the drawers 41 and 46 and to make a rolling motion. The drawers 41 and 46 may have front rollers 43 and 48 and rear rollers 44 and 49 so as to distribute and support the loads of the drawers 41 and 46. The front rollers 43 and 48 may be supported on a door rail assembly 80 that will be described later, and the rear rollers 44 and 49 may be supported on a guide rib 90 that will be described later.

The guide rib 90 may be provided in sidewalls of the body 10 so as to guide movement of the drawers 41 and 46 and to slidably support the drawers 41 and 46. The guide rib 90 may be disposed separately from the inner case 11 of the body 10 and may be coupled to the inner case 11 or formed integrally with the inner case 11. The guide rib 90 may have a roller support 91 configured to support the rear rollers 44 and 49 of the drawers 41 and 46.

As described above, the drawers 41 and 46 are supported by the rollers 43, 44, 48, and 49 instead of the door rail assembly 80 so that the number of components can be reduced, a structure can be simplified and costs can be reduced.

The refrigerator compartment 21 may be opened/closed by a pair of doors 25 and 26. The pair of doors 25 and 26 may be rotatably coupled to the body 10 using a hinge member. A door guard in which food can be stored, and a dispenser configured to provide water or ice may be disposed in the refrigerator compartment doors 25 and 26.

The freezer compartment 22 may be opened/closed by the freezer compartment door 30 which is slidably provided. The freezer compartment door 30 may be formed by assembling a front panel 31, a rear panel 32, an upper cap, and a lower cap. An insulating material 35 may be disposed inside the freezer compartment door 30. The freezer compartment door 30 may have a handle portion 36 which can be gripped to open or close the freezer compartment door 30. The handle portion 36 may include a handle body 37 and a handle groove 38. A gasket 39 may be provided at a rear surface of the freezer compartment door 30 so as to seal the freezer compartment 22.

The freezer compartment door 30 may be sliably supported by the door rail assembly 80. The door rail assembly 80 may include a fixed rail 81 fixed to the sidewalls of the body 10, and a moving rail 82 fixed to the freezer compartment door 30 and being movable relative to the fixed rail 81. An intermediate rail 83 may be disposed between the fixed rail 81 and the moving rail 82 so as to increase drawing distance of the moving rail 82. In other words, the door rail assembly 80 according to the current embodiment may be a 3-stage rail. A bearing member 84 may be disposed between the rails 81, 82, and 83 so as to reduce frictional force and to enable the rails 81, 82, and 83 to move smoothly.

A roller support 85 may be provided in the moving rail 82 so as to support the front rollers 43 and 48 of the drawers 41 and 46 described above.

The selective drawing device 50 may be provided in the freezer compartment door 30 so as to select one from among the plurality of drawers 41 and 46 and to draw the drawer together with the freezer compartment door 30. When the selective drawing device 50 selects the upper drawer 41, the upper drawer 41 may be drawn together with the freezer compartment door 30 when the freezer compartment door 30 is drawn, and when the lower drawer 46 is selected, the lower drawer 46 may be drawn together with the freezer compartment door 30 when the freezer compartment door 30 is drawn.

In this way, one may be selected from among the upper drawer 41 and the lower drawer 46 using the selective drawing device 50 and may be drawn together with the freezer compartment door 30 so that a user may draw a drawer to be used conveniently, a drawer not to be used does not need to be drawn and thus, unnecessary cold air leakage may be prevented from occurring.

The selective drawing device 50 may include a switch 51 being operable to select a drawer to be drawn from among the plurality of drawers 41 and 46, and a selector 71 disposed to connect one selected from among the plurality of drawers 41 and 46 according to manipulation of the switch 51 to the freezer compartment door 30.

The switch 51 may be provided in an approachable position in a state in which the freezer compartment door 30 is closed. In an example, the switch 51 may be provided in the handle portion 36 of the freezer compartment door 30. From a different viewpoint, the switch 51 may be disposed outside the freezer compartment 22. On the other hand, the selector 71 is disposed inside the freezer compartment 22 so as to be connected to the plurality of drawers 41 and 46.

The switch 51 may be movable in left and right directions. When the switch 51 is moved to the left, the selector 71 may be connected to the upper drawer 41, and when the switch 51 is moved to the right, the selector 71 may be connected to the lower drawer 46. However, unlike in the current embodiment, the switch 51 may be movable not only in the left and right directions but also in a vertical direction and may be rotatable in the form of a knob.

The selector 71 may be disposed at the rear surface of the freezer compartment door 30 so as to be connected to the connector 42 of the upper drawer 41 and the connector 47 of the lower drawer 46. The selector 71 may be rotatable around a rotation shaft 72. A plurality of selectors 71 may be provided at both sides of the selective drawing device 50 so that the drawers 41 and 46 may be stably drawn together with the freezer compartment door 30.

A connection opening (see 32*a* of FIG. 7) through which the switch 51 is connected to the selector 71, may be formed in the rear panel 32 of the freezer compartment door 30. That is, the switch 51 outside the freezer compartment 22, and the selector 71 inside the freezer compartment 22 may be connected to each other via the connection opening 32*a* of the rear panel 32 of the freezer compartment door 30.

Hereinafter, a detailed configuration of the selective drawing device 50 and an operation of selecting one from among the plurality of drawers 41 and 46 using the selective drawing device 50 and drawing the one drawer together with the freezer compartment door 30 will be described.

Figure 7:
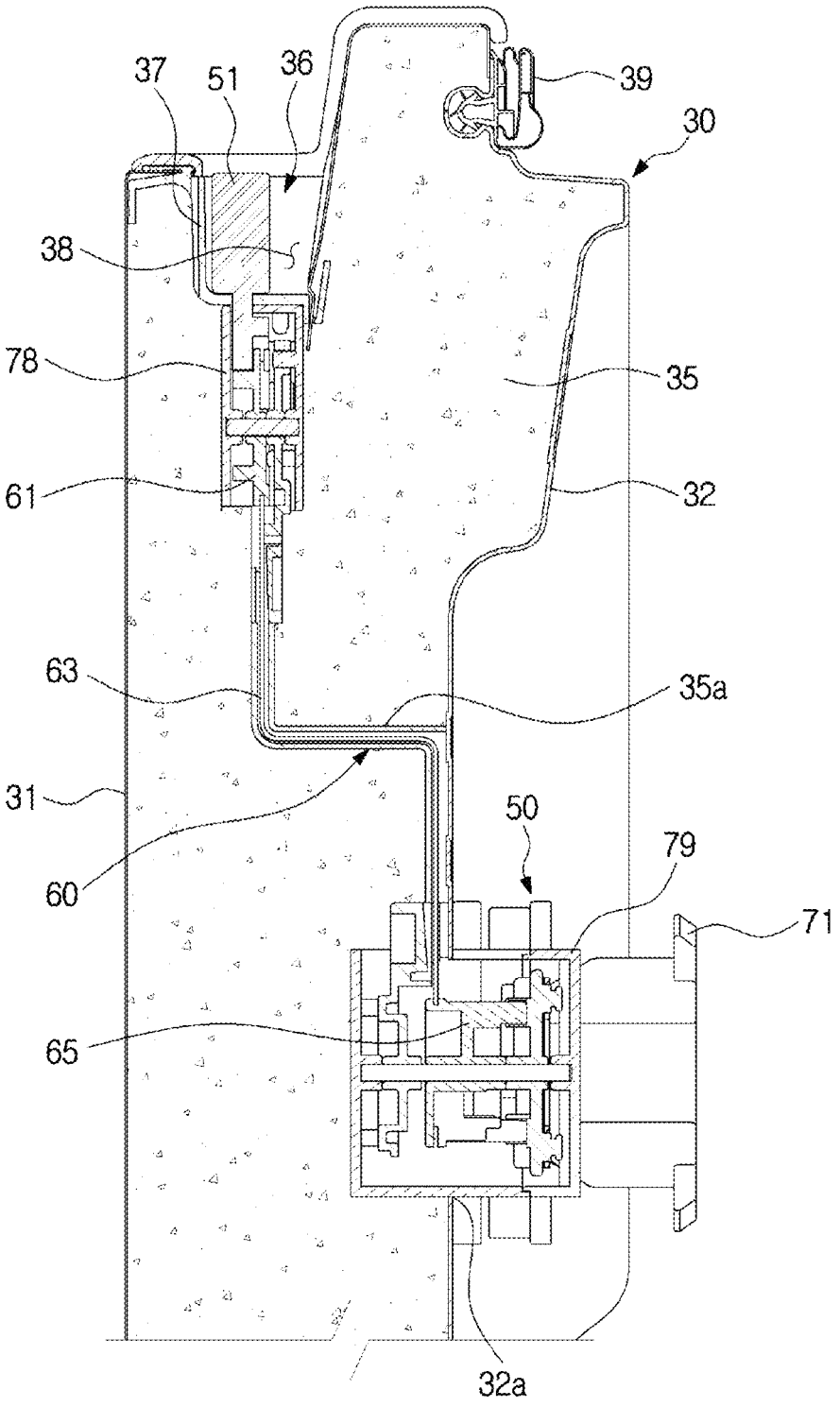
FIG. 7 is a partial cross-sectional view of a door of the refrigerator of FIG. 1.
Figure 8:
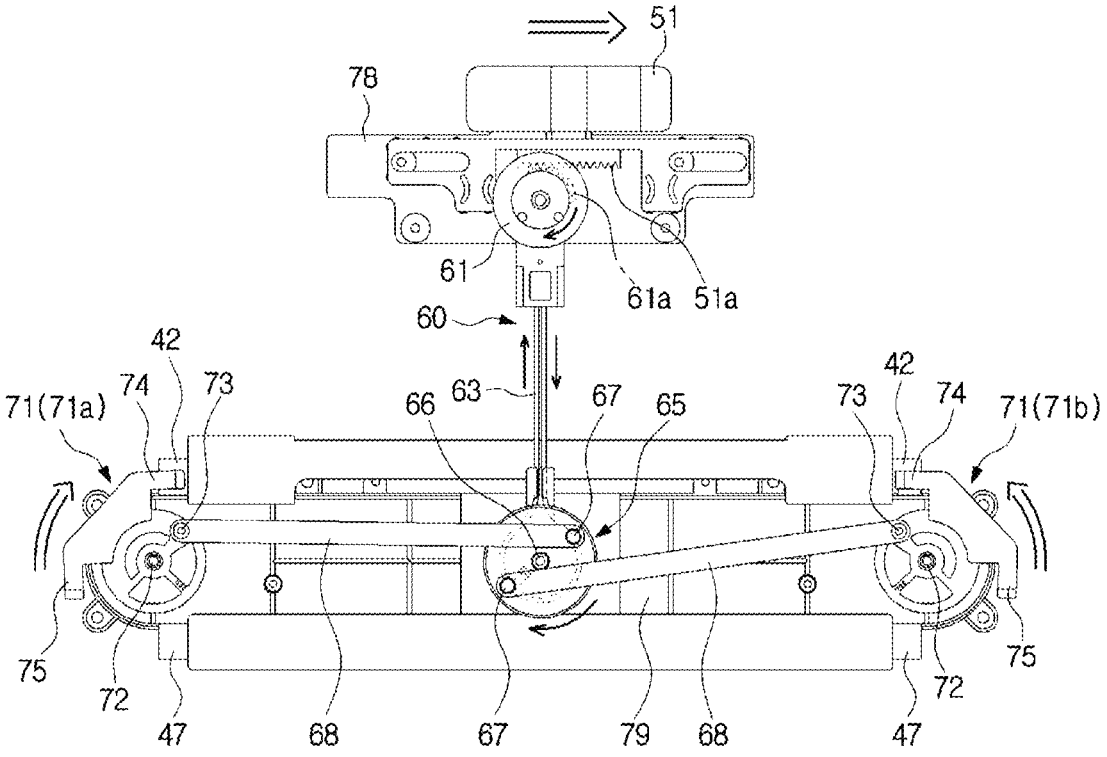
FIGS. 8 and 9 are views illustrating an operation of selecting an upper drawer using a selective drawing device and drawing the upper drawer together with the door.
Figure 9:
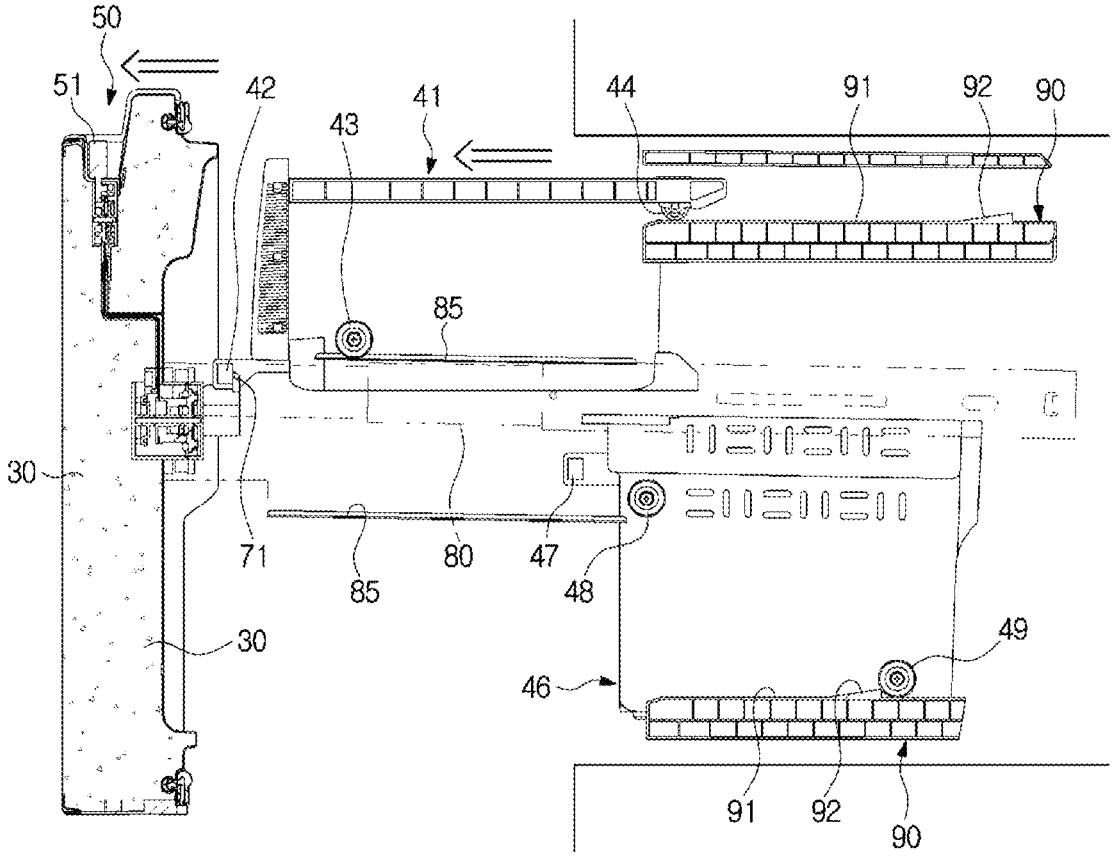
Figure 10:
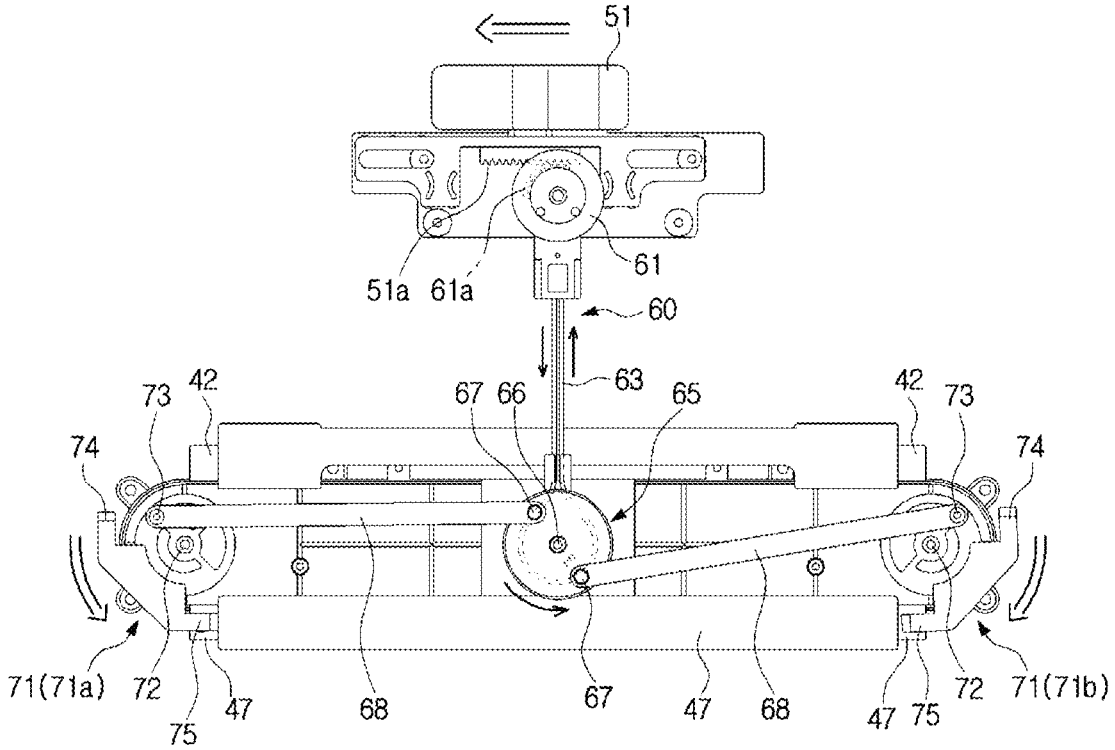
FIGS. 10 and 11 are views illustrating an operation of selecting a lower drawer using the selective drawing device and drawing the lower drawer together with the door.
Figure 11:
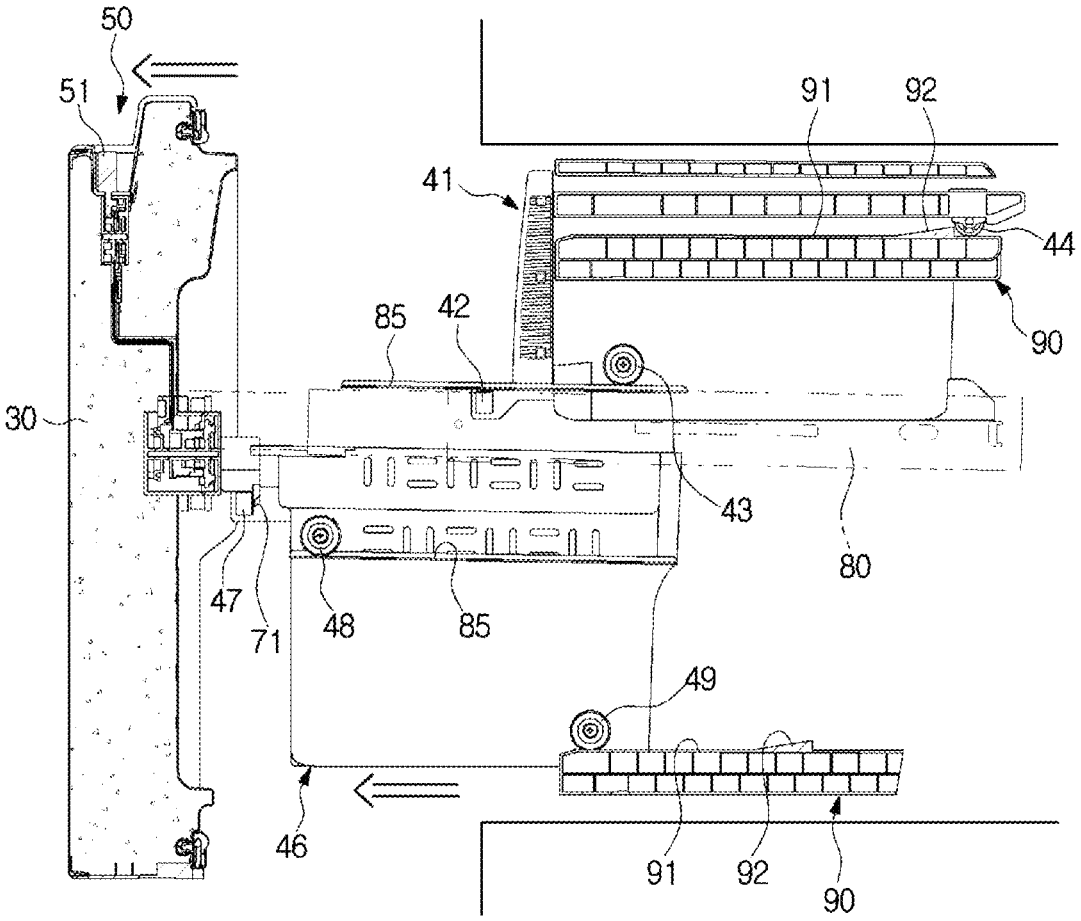

FIG. 7 is a partial cross-sectional view of a door of the refrigerator of FIG. 1. FIGS. 8 and 9 are views illustrating an operation of selecting an upper drawer using a selective drawing device and drawing the upper drawer together with the door. FIGS. 10 and 11 are views illustrating an operation of selecting a lower drawer using the selective drawing device and drawing the lower drawer together with the door.

Referring to FIGS. 7 through 11, the selective drawing device 50 may be provided in the freezer compartment door 30. The selective drawing device 50 may include the switch 51 disposed to operate to select a drawer to be drawn from among the plurality of drawers 41 and 46, and the selector 71 connected to one drawer selected from among the plurality of drawers 41 and 46 by manipulation of the switch 51.

The switch 51 may make a linear motion in the left and right directions, and the selector 71 may be rotatable around the rotation shaft 72. The selector 71 may include a left selector 71*a* and a right selector 71*b*, which are respectively disposed in the left and right directions. The left selector 71*a* and the right selector 71*b* may have the connection protrusion 74 that may be connected to the connector 42 of the upper drawer 41 and the connection protrusion 75 that may be connected to the connector 47 of the lower drawer 46.

The selective drawing device 50 may include a switch case 78 in which the switch 51 is accommodated and mounted, and a selector case 79 in which the selector 71 is accommodated and mounted. The switch case 78 may be installed at the handle portion 36 of the freezer compartment door 30.

The selector case 79 may be installed at the rear surface of the freezer compartment door 30. In the current embodiment, the selector case 79 is installed to pass through the connection opening 32*a* of the rear panel 32 of the freezer compartment door 30. However, unlike this, the selector case 79 may also be attached to the rear surface of the rear panel 32 of the freezer compartment door 30.

The selective drawing device 50 may include a power transmission unit 60 configured to transmit manipulation force of the switch 51 to the selector 71. The power transmission unit 60 may include an intermediate rotation body 65 that rotates according to a rectilinear motion of the switch 51, and a connection rod 68 configured to connect the intermediate rotation body 65 to the selector 71 so as to rotate the selector 71 according to rotation of the intermediate rotation body 65.

The intermediate rotation body 65 may be provided between the left and right selectors 71*a* and 71*b* so as to be rotatable around a rotation shaft 66. One end of the connection rod 68 may be connected to the intermediate rotation body 65 at a connection point 67 that is eccentric from the rotation shaft 66 of the intermediate rotation body 65, and the other end of the connection rod 68 may be connected to the selector 71 at a connection point 73 that is eccentric from the rotation shaft 72 of the selector 71.

Through this configuration, as illustrated in FIG. 8, when the switch 51 makes a rectilinear motion in one direction, the intermediate rotation body 65 may rotate in one direction, and the left selector 71*a* may be rotated in the same direction as that of the intermediate rotation body 65, and the right selector 71*b* may be rotated in a different direction from that of the intermediate rotation body 65. Thus, top connection protrusions 74 of the left selector 71*a* and the right selector 71*b* may be connected to the connector 42 of the upper drawer 41.

Conversely, as illustrated in FIG. 10, when the switch 51 makes a rectilinear motion in an opposite direction, the intermediate rotation body 65 may rotate in the opposite direction, and bottom connection protrusions 75 of the left selector 71*a* and the right selector 71*b* may be connected to the connector 47 of the lower drawer 46.

The switch 51 may include a rack gear portion 51*a*, and the power transmission unit 60 may include a pinion 61 having a pinion gear portion 61*a* engaged with the rack gear portion 51*a*, and a wire member 63 configured to transmit rotational force of the pinion 61 to the intermediate rotation body 65. When the switch 51 makes a rectilinear motion in one direction, the pinion 61 may be engaged with the switch 51 and rotated, and the rotational force of the pinion 61 may be transmitted to the intermediate rotation body 65 via the wire member 63 so that the intermediate rotation body 65 can be rotated. A wire casing 35*a* that accommodates the wire member 63 so that the wire member 63 can be smoothly moved, may be provided inside the insulating material 35 of the freezer compartment door 30. The wire casing 35*a* may have a minimum size so that a maximum thickness of the insulating material 35 of the freezer compartment door 30 can be ensured. Alternatively, the wire member 63 is directly embedded in the insulating material 35, and the wire casing 35*a* may not be provided.

Through this configuration, as illustrated in FIGS. 8 and 9, when the freezer compartment door 30 is drawn in a state in which the freezer compartment door 30 is connected to the upper drawer 41 using the selective drawing device 50, the upper drawer 41 may be drawn together with the freezer compartment door 30.

In this case, the lower drawer 46 may not be moved but may be kept in place. To this end, a stopper 92 may be provided in the guide rib 90 so as to prevent the lower drawer 46 from being drawn forward due to friction between the front roller 48 of the lower drawer 46 and the moving rail 82. The stopper 92 may be a protrusion that protrudes from the roller support 91.

When the upper drawer 41 is connected to the freezer compartment door 30 and is drawn together with the freezer compartment door 30, the rear roller 49 of the lower drawer 46 may be caught in the stopper 92 so that the lower drawer 46 may be prevented from being drawn. In this case, the front roller 48 of the lower drawer 46 may make a rolling motion in place due to friction with the moving rail 82 that moves forward.

As illustrated in FIGS. 10 and 11, when the freezer compartment door 30 is drawn using the selective drawing device 50 in a state in which the freezer compartment door 30 and the lower drawer 46 are connected to each other, the lower drawer 46 may be drawn together with the freezer compartment door 30.

In this case, the upper drawer 41 may not be moved and may be kept in place. To this end, the guide rib 90 may include the stopper 92 so as to prevent the upper drawer 41 from being drawn in a forward direction due to friction between the front roller 43 of the upper drawer 41 and the moving rail 82. The stopper 92 may be a protrusion that protrudes from the roller support 91.

When the lower drawer 46 is connected to the freezer compartment door 30 and is drawn together with the freezer compartment door 30, the rear roller 44 of the upper drawer 41 may be caught in the stopper 92 so that the upper drawer 41 may be prevented from being drawn. In this case, the front roller 43 of the upper drawer 41 may make a rolling motion in place due to friction with the moving rail 82 that moves forward.

Figure 12:
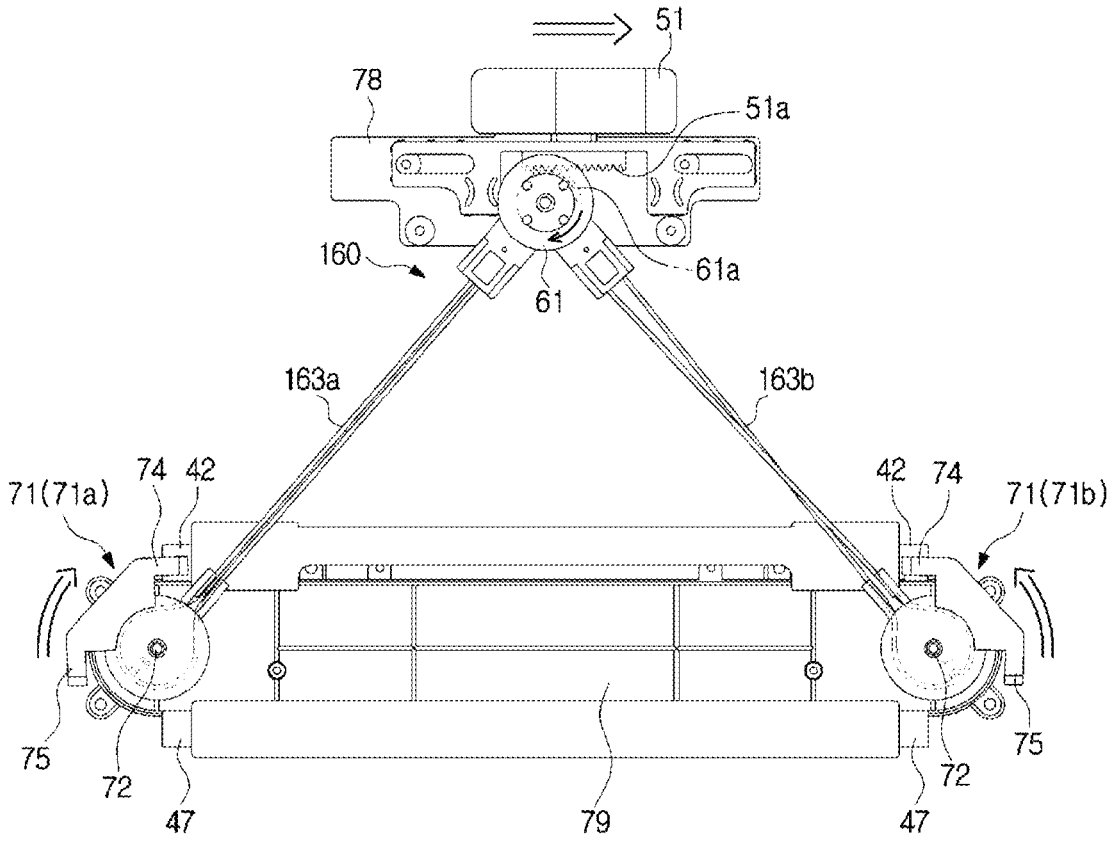
FIG. 12 is a view of a selective drawing device according to another embodiment of the present disclosure.

FIG. 12 is a view of a selective drawing device according to another embodiment of the present disclosure. The selective drawing device according to another embodiment of the present disclosure will be described with reference to FIG. 12. Like reference numerals are used for like elements as those of the above-described embodiment, and descriptions thereof will be omitted.

The selective drawing device 50 may include a power transmission unit 160 that transmits manipulation force of the switch 51 to the selector 71. The switch 51 may include a rack gear portion 51*a*, and the power transmission unit 160 may include a pinion 61 having a pinion gear portion 61*a* engaged with the rack gear portion 51*a*, and wire members 163*a* and 163*b* disposed to transmit rotational force of the pinion 61 to the plurality of selectors 71*a* and 71*b*.

When the switch 51 makes a rectilinear motion in one direction, the pinion 61 may be engaged with the switch 51 and may be rotated, and the rotational force of the pinion 61 may be transmitted to the left and right selectors 71*a* and 71*b* via the wire members 163*a* and 163*b*.

When the pinion 61 is rotated, one wire member 163*b* between the wire members 163*a* and 163*b* may be connected between the pinion 61 and the right selector 71*b* so that the left selector 71*a* and the right selector 71*b* may be rotated in different directions, and thus the wire member 163*b* may have a cross shape.

In the power transmission unit 160 according to the current embodiment, the intermediate rotation body 65 and the connection rod 68 according to the above-described embodiment are omitted, and the pinion 61 is directly connected to the left and right selectors 71*a* and 71*b* via the wire members 163*a* and 163*b* so that the size of the selective drawing device may be further reduced.

Figure 13:
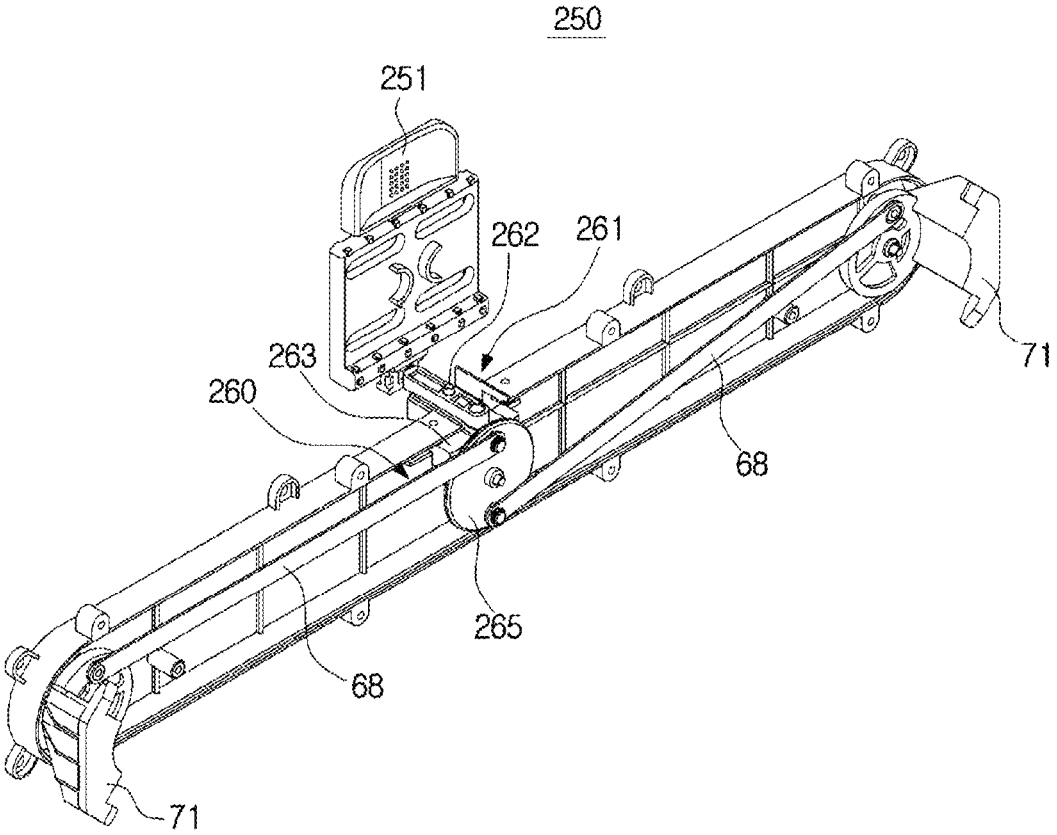
FIG. 13 is a view of a selective drawing device according to another embodiment of the present disclosure.

FIG. 13 is a view of a selective drawing device according to another embodiment of the present disclosure. A selective drawing device 250 according to another embodiment of the present disclosure will be described with reference to FIG. 13. Like reference numerals are used for like elements as those of the above-described embodiments, and descriptions thereof will be omitted.

A power transmission unit 260 that transmits manipulation force of a switch 251 to a selector 71 may include a lever member 261 and a slide member 263 instead of the pinion and the wire members in the above-described embodiments.

That is, the selective drawing device 250 may include the switch 251 being operable to select a drawer to be drawn from among a plurality of drawers 41 and 46, the selector 71 connected to one selected from the plurality of drawers 41 and 46 according to manipulation of the switch 251, an intermediate rotation body 265 that rotates according to a rectilinear motion of the switch 251, a connection rod 68 configured to connect the intermediate rotation body 265 to the selector 71 so as to rotate the selector 71 according to rotation of the intermediate rotation body 265, the lever member 261 being rotatable around a rotation shaft 262 so as to rotate the intermediate rotation body 265 according to a rectilinear motion of the switch 251, and the slide member 263 that makes a rectilinear motion according to a rotational motion of the lever member 261.

The lever member 261 may include an input part, which is disposed at one side thereof around the rotation shaft 262 and pressurized by the switch 251, and an output part, which is disposed at an opposite side to the side at which the input part is disposed, around the rotation shaft 262 and enables the slide member 263 to make a rectilinear motion. The slide member 263 may include a rack gear portion, and the intermediate rotation body 265 may include an intermediate rotation body gear portion. The rack gear portion and the intermediate rotation body gear portion may be engaged with each other, and the intermediate rotation body 265 may rotate when the slide member 263 makes a rectilinear motion.

Figure 14:
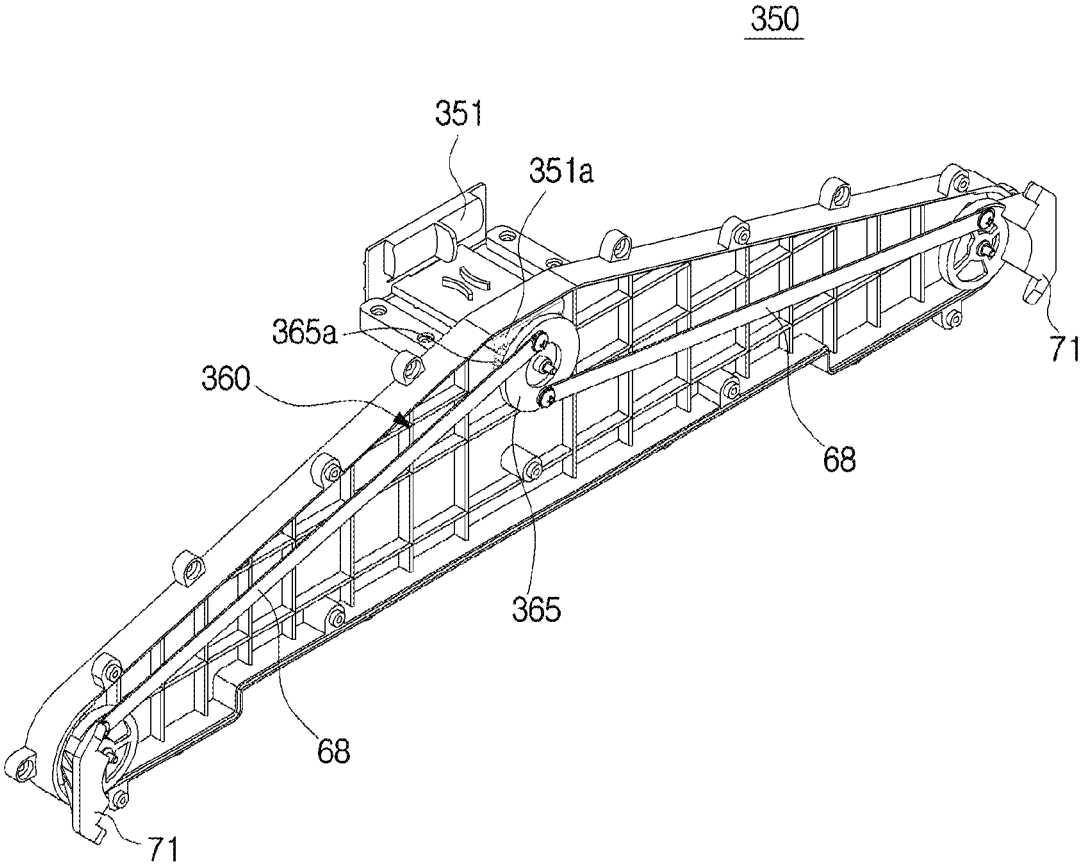
FIG. 14 is a view of a selective drawing device according to another embodiment of the present disclosure.

FIG. 14 is a view of a selective drawing device according to another embodiment of the present disclosure. A selective drawing device 350 according to another embodiment of the present disclosure will be described with reference to FIG. 14. Like reference numerals are used for like elements as those of the above-described embodiments, and descriptions thereof will be omitted.

A power transmission unit 360 configured to transmit manipulation force of a switch 351 to a selector 71 may not include the pinion, the wire member, and the lever member in the above-described embodiments.

The selective drawing device 350 may include the switch 351 being operable to select a drawer to be drawn from among a plurality of drawers 41 and 46, the selector 71 connected to one selected from the plurality of drawers 41 and 46 according to manipulation of the switch 351, an intermediate rotation body 365 that rotates according to a rectilinear motion of the switch 351, and a connection rod 68 configured to connect the intermediate rotation body 365 to the selector 71 so as to rotate the selector 71 according to rotation of the intermediate rotation body 365. Here, the switch 351 may transmit power directly to the intermediate rotation body 365.

That is, the switch 351 may include a rack gear portion 351*a*, and the intermediate rotation body 365 may include an intermediate rotation body gear portion 365*a* engaged with the rack gear portion 351*a* so that the intermediate rotation body 365 may rotate according to a rectilinear motion of the switch 351.

Figure 15:
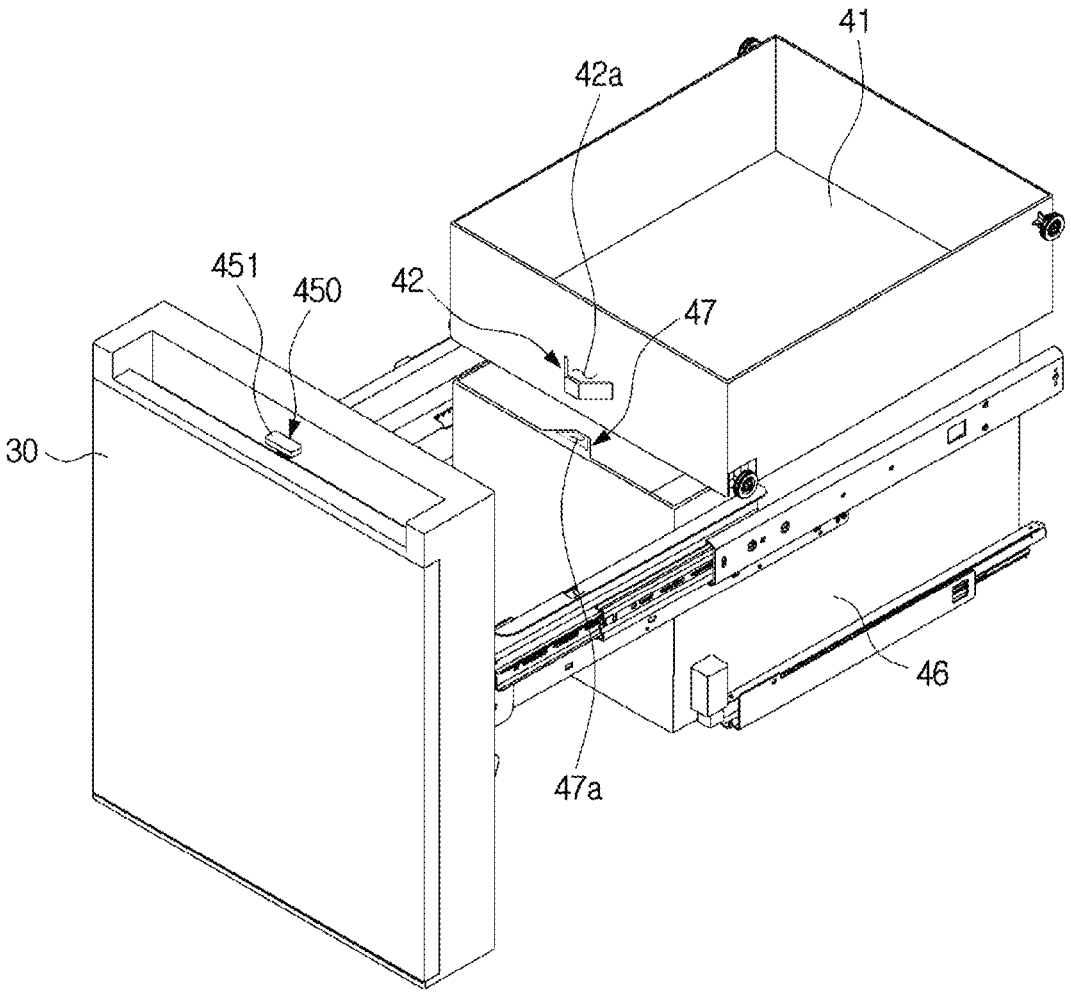
FIGS. 15, 16 and 17 are views of a selective drawing device according to another embodiment of the present disclosure.
Figure 16:
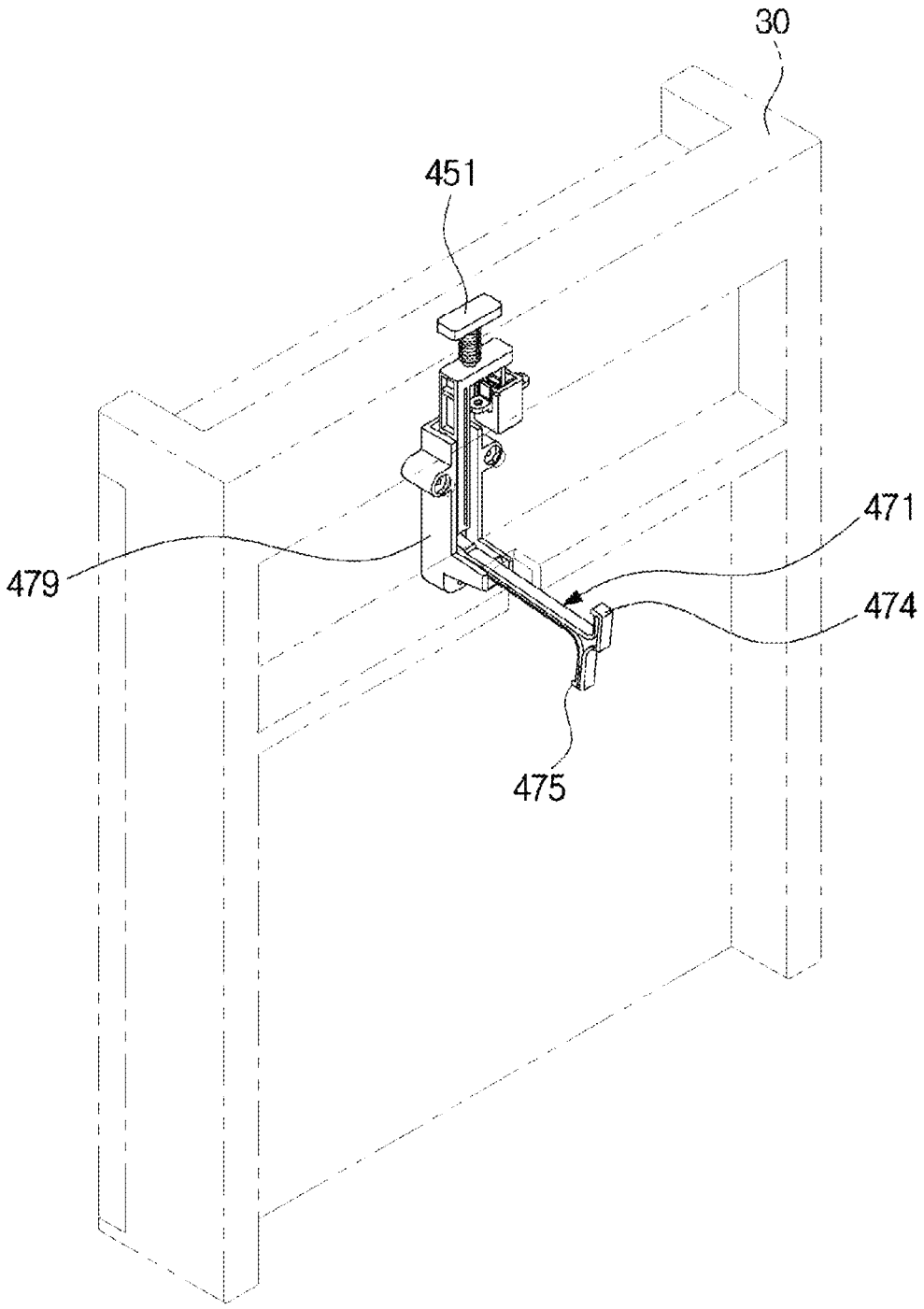
Figure 17:
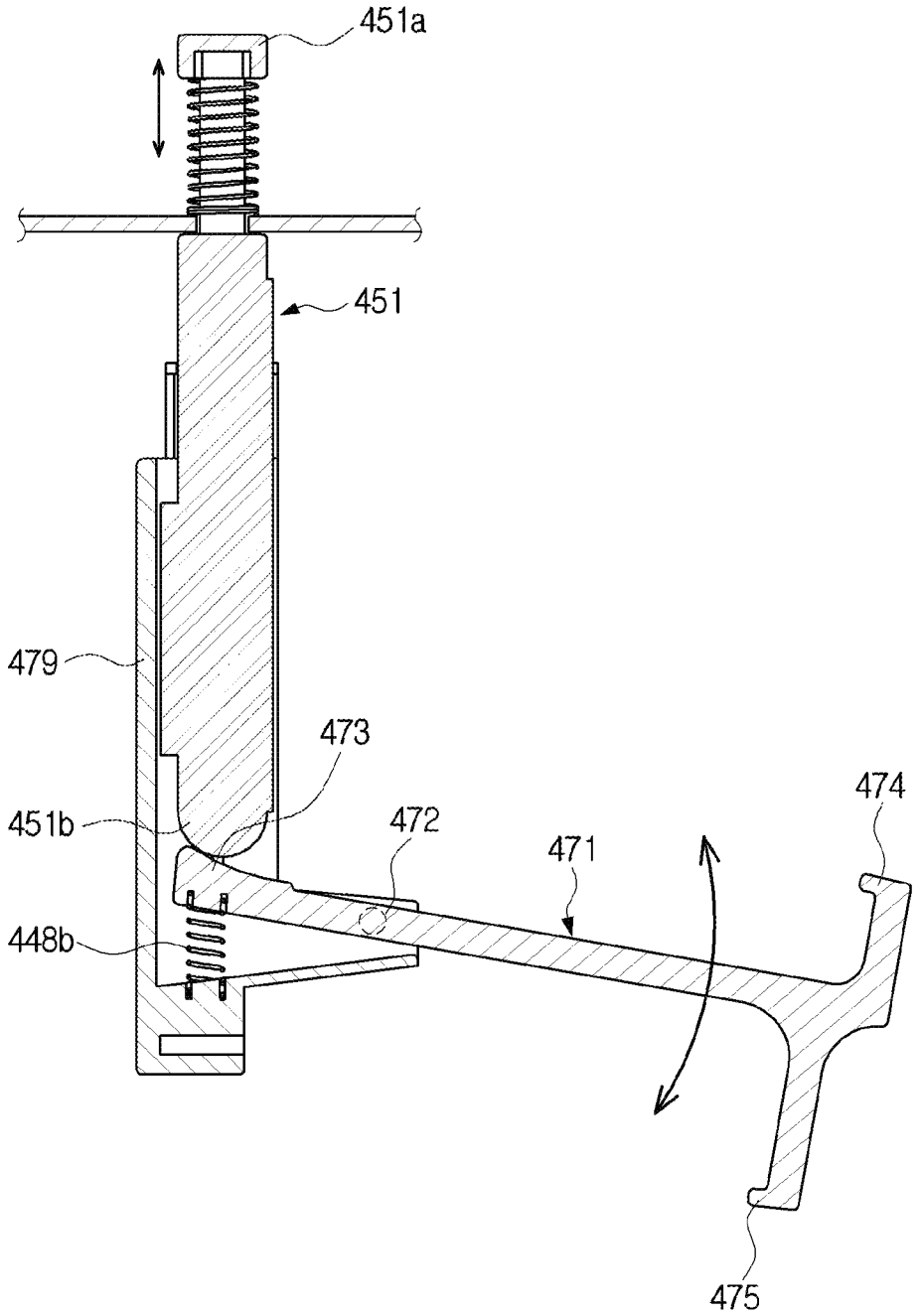

FIGS. 15 through 17 are views of a selective drawing device according to another embodiment of the present disclosure. A selective drawing device 450 according to another embodiment of the present disclosure will be described with reference to FIGS. 15 through 17. Like reference numerals are used for like elements as those of the above-described embodiments, and descriptions thereof will be omitted.

Unlike in the above-described embodiments, a switch 451 may be movable in the vertical direction so that manipulation force of the switch 451 may be transmitted directly to a selector 471 without an additional power transmission unit.

That is, the selective drawing device 450 may include the switch 451 that is operable to select a drawer to be drawn from among a plurality of drawers 41 and 46, and a selector 471 connected to one selected from among the plurality of drawers 41 and 46 according to manipulation of the switch 451, and manipulation force of the switch 451 may be transmitted directly to the selector 471.

The switch 451 is provided inside a case 479 so as to be movable in the vertical direction and may include a manipulation portion 451*a* that the user may press, and a pressurizing portion 451*b* configured to pressurize the selector 471.

The selector 471 may be rotatable around a rotation shaft 472 and may include an operating portion 473, which is disposed at one side thereof around the rotation shaft 472 and pressurized by the switch 451, and connection protrusions 474 and 475, which are disposed at the other side opposite the side at which the operating portion 473 is disposed and may be connected to connectors 42 and 47 of the upper and lower drawers 41 and 46. The connectors 42 and 47 may include connection grooves 42*a* and 47*a*, and the connection protrusions 474 and 475 may be inserted into the connection grooves 42*a* and 47*a*.

An elastic member 448*b* may elastically support the selector 471 so that the connection protrusion 475 may be kept in a state of being connected to the connector 47 of the lower drawer 46. When the user presses the switch 451, the selector 471 may be rotated so that the connection protrusion 474 may be connected to the connector 42 of the upper drawer 41.

Figure 18:
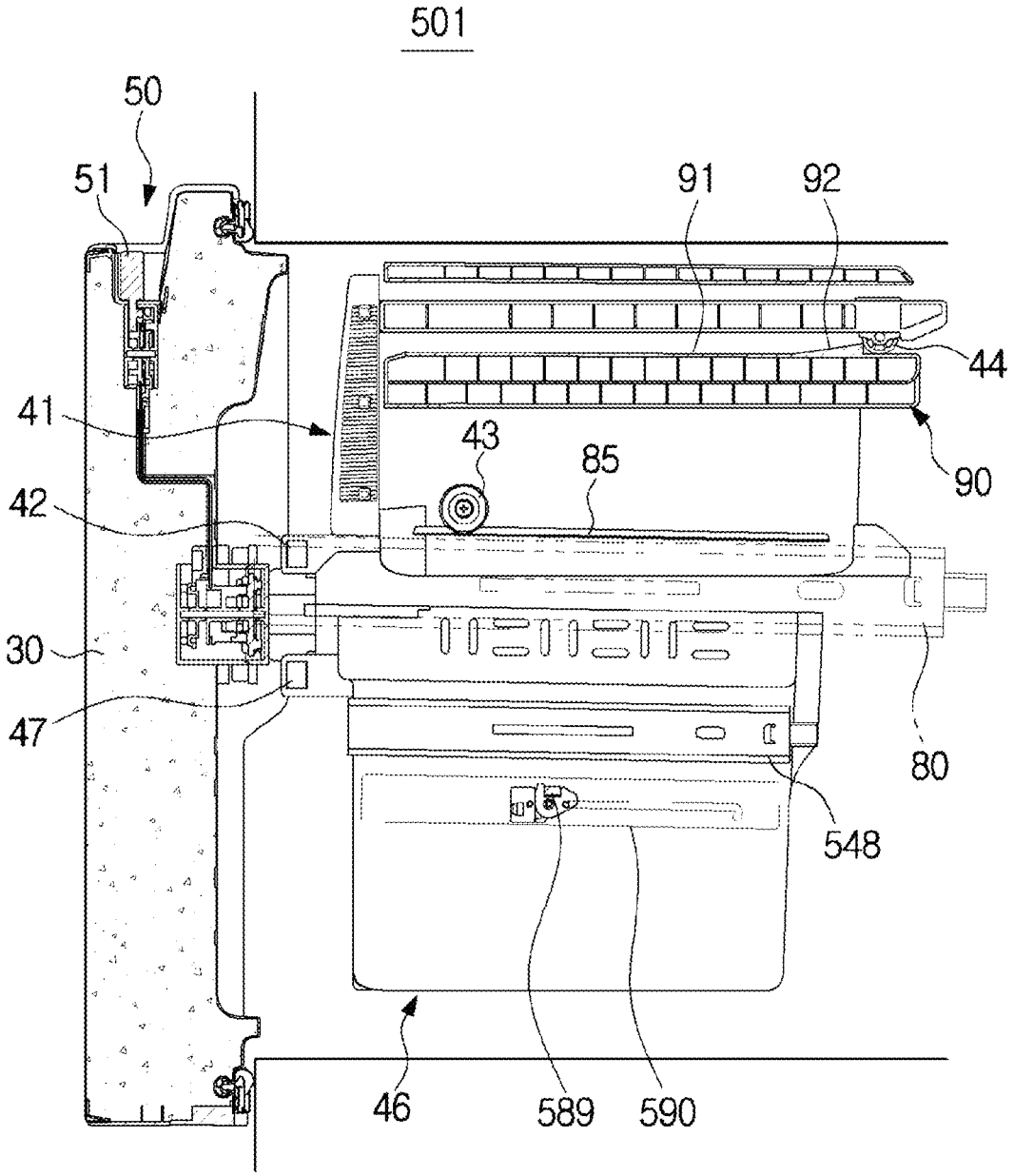
FIGS. 18 through 20 are views of a drawer supporting structure according to another embodiment of the present disclosure.
Figure 19:
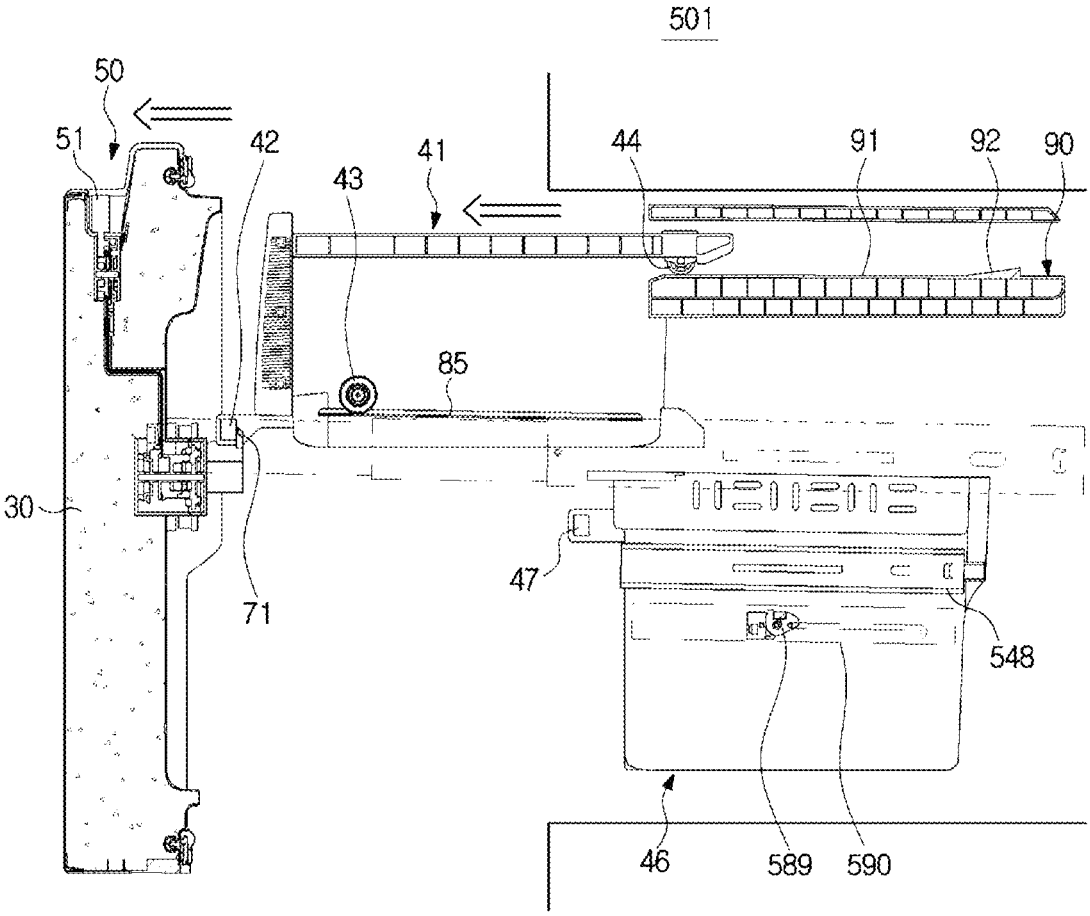
Figure 20:
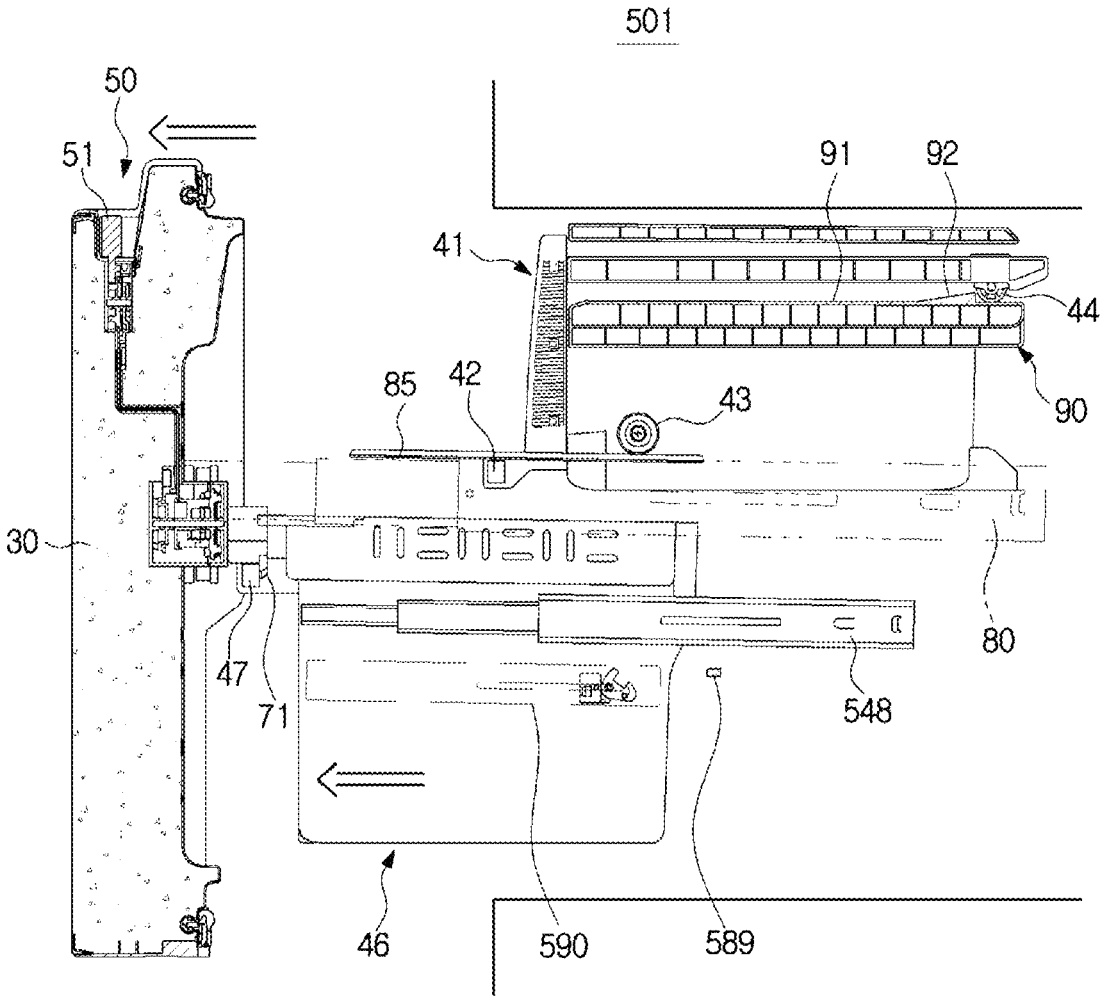
Figure 21:
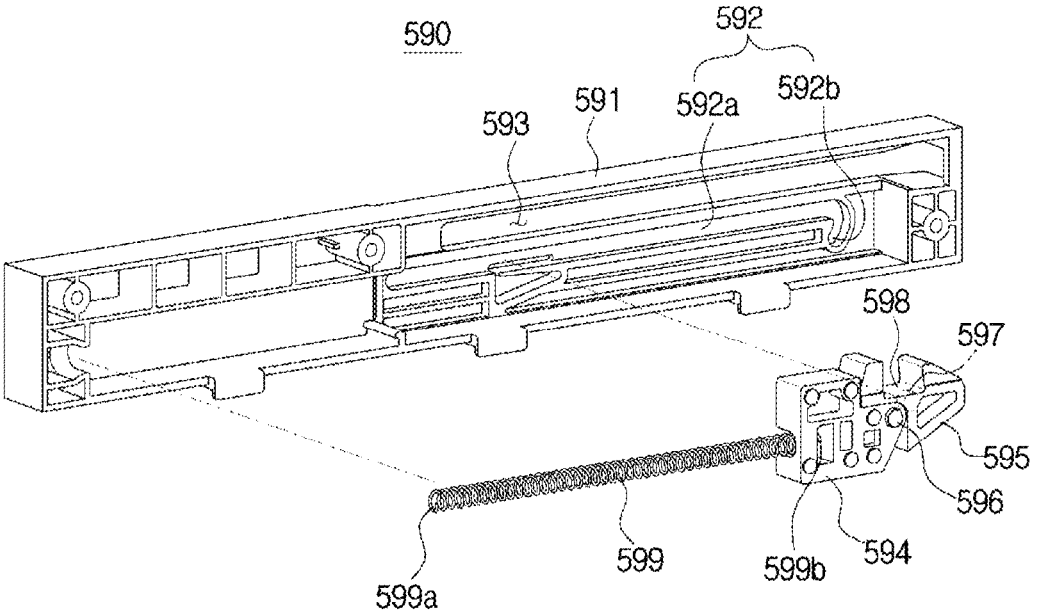
FIG. 21 is a view of a configuration of an automatic closing device according to an embodiment of the present disclosure.

FIGS. 18 through 20 are views of a drawer supporting structure according to another embodiment of the present disclosure, and FIG. 18 illustrates a state in which a door is closed, and FIG. 19 illustrates a state in which, when the door is drawn, an upper drawer is drawn together, and FIG. 20 illustrates a state in which, when the door is drawn, a lower drawer is drawn together. FIG. 21 is a view of a configuration of an automatic closing device according to an embodiment of the present disclosure.

The drawer supporting structure according to another embodiment of the present disclosure will be described with reference to FIGS. 18 through 20. Like reference numerals are used for like elements as those of the above-described embodiments, and descriptions thereof will be omitted.

In a structure of supporting the freezer compartment door 30 and the upper and lower drawers 41 and 46 in the above-described embodiments, the door rail assembly 80 is used only in the freezer compartment door 30, and the rollers 43, 44, 48, and 49 are used in the upper drawer 41 and the lower drawer 46. However, the door rail assembly 80 may also be used in the upper drawer 41 and the lower drawer 46.

That is, a refrigerator 501 may include upper and lower drawers 41 and 46 provided inside a storage compartment so as to be slidable, a freezer compartment door 30 that is slidable to open/close the storage compartment, a door rail assembly 80 configured to support the freezer compartment door 30 to be slidable, and a drawer rail assembly 548 configured to support the lower drawer 46 from among the plurality of drawers 41 and 46 to be slidable. The upper drawer 41 may be slidable by a front roller 43 supported on the door rail assembly 80 and a rear roller 44 supported on a guide rib 90, as in the above-described embodiments.

The drawer rail assembly 548 that supports the lower drawer 46 slidably may have the same configuration as that of the door rail assembly 80. That is, the drawer rail assembly 548 may include a fixed rail fixed to a body 10, a moving rail fixed to the lower drawer 46 and being slidable with respect to the fixed rail, and an intermediate rail disposed between the fixed rail and the moving rail, and a bearing member may be disposed between the fixed rail and the moving rail so as to reduce frictional force therebetween and to enable the fixed rail and the moving rail to operate smoothly.

The refrigerator 501 may include an automatic closing device 590 that enables the lower drawer 46 not to be moved but to be kept in place when the upper drawer 41 is selected by the selective drawing device 50 and the freezer compartment door 30 and the upper drawer 41 are drawn together.

As illustrated in FIG. 21, the automatic closing device 590 may include a case 591, a slider 594 that makes a rectilinear motion inside the case 591, a rotator 595 coupled to one side of the slider 594 to be rotatable, and an elastic member 599 that elastically supports the slider 594. One end 599*a* of the elastic member 599 may be fixed to the case 591, and the other end 599*b* of the elastic member 599 may be fixed to the slider 594.

The case 591 may be fixed to the lower drawer 46 and moved together with the lower drawer 46 and may accommodate the slider 594, the rotator 595, and the elastic member 599. A guide groove 592 configured to guide movement of the slider 594 and the rotator 595 may be formed in the case 591. The guide groove 592 may include a long hole part 592*a* long formed in a movement direction of the lower drawer 46, and a locking part 592*b* formed in an end of the long hole part 592*a* so that the rotator 595 may rotate and a protrusion 597 of the rotator 595 may be caught in the locking part 592*b*.

A hanging protrusion passage groove 593 that extends in parallel to the guide groove 592 may be formed in the case 591, and a hanging protrusion 589 fixed to the body 10 may pass through the hanging protrusion passage groove 593 and may be caught in a hanging groove 598 of the rotator 595. The hanging protrusion 589 may be integrally formed with the inner case 11 of the body 10 or may be separately provided and may be fixed to the inner case 11 or may be formed in a fixed rail of the drawer rail assembly 548.

The rotator 595 may be rotatably coupled to one side of the slider 594 using a coupling pin 596, and may not rotate when moving on the long hole part 592*a* and may rotate and be caught in the locking part 592*b* when reaching the locking part 592*b*.

Through this configuration, when the lower drawer 46 is drawn, the hanging protrusion 589 fixed to the body 10 is caught in the hanging groove 598 of the rotator 595 so that the elastic member 599 may be pulled and elastic force is applied in a direction in which the lower drawer 46 is closed. When the lower drawer 46 is drawn up to a predetermined drawing distance, the rotator 595 reaches the locking part 592*b* and rotates so that the hanging protrusion 589 may be deviated from the hanging groove 598 of the rotator 595.

In this way, the automatic closing device 590 may enable the lower drawer 46 not to be moved but to be kept in place when the upper drawer 41 is selected by the selective drawing device 50 using elastic force of the elastic member 599 and the freezer compartment door 30 and the upper drawer 41 are drawn together.

Figure 22:
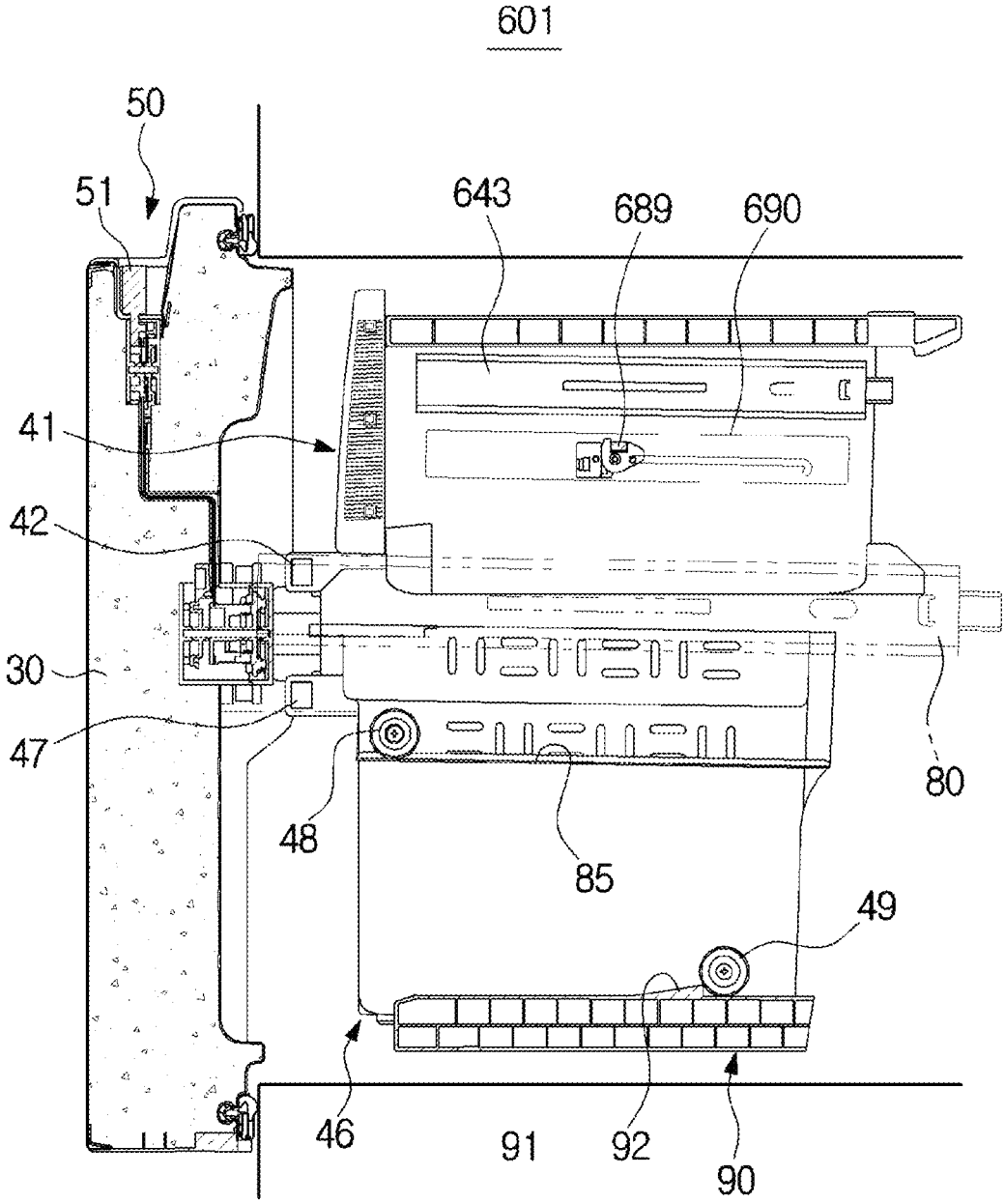
FIGS. 22 through 24 are views of a drawer supporting structure according to another embodiment of the present disclosure. In detail.
Figure 23:
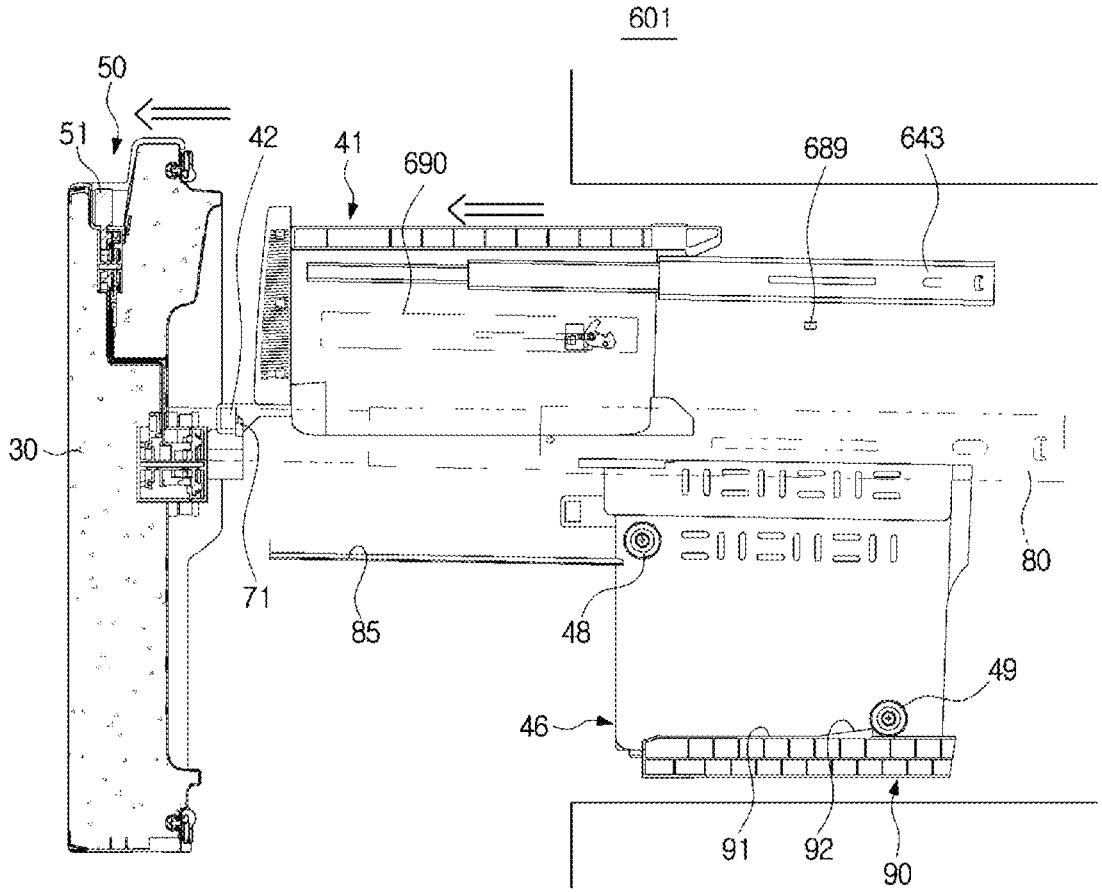
Figure 24:
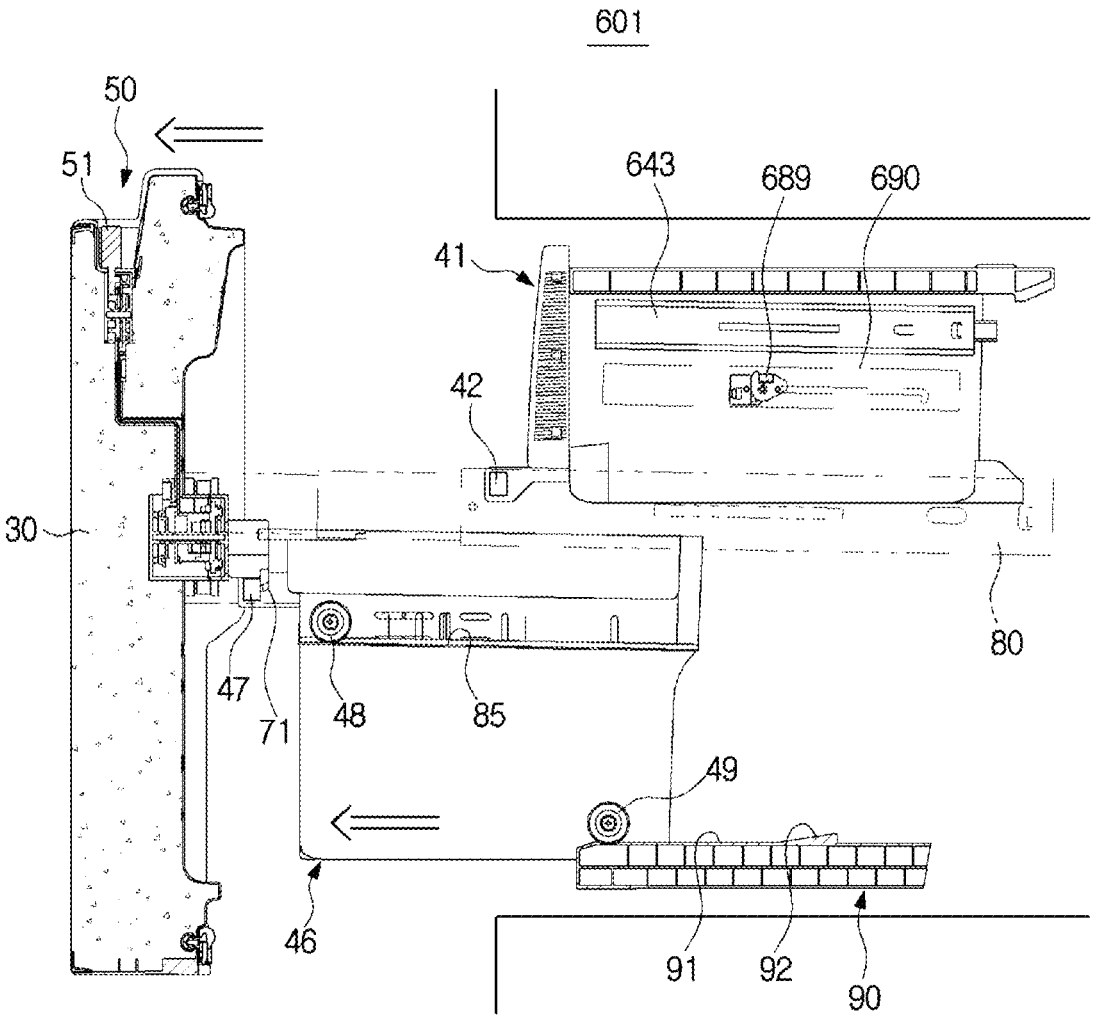

FIGS. 22 through 24 are views of a drawer supporting structure according to another embodiment of the present disclosure. In detail, FIG. 22 illustrates a state in which a door is closed, and FIG. 23 illustrates a state in which an upper drawer is drawn together when the door is drawn, and FIG. 24 illustrates a state in which a lower drawer is drawn together when the door is drawn.

The drawer supporting structure according to another embodiment of the present disclosure will be described with reference to FIGS. 22 through 24. Like reference numerals are used for like elements as those of the above-described embodiment, and descriptions thereof will be omitted.

A refrigerator 601 may include a plurality of drawers 41 and 46 provided inside a storage compartment to be slidable, a freezer compartment door 30 configured to open/close the storage compartment slidably, a door rail assembly 80 configured to support the freezer compartment door 30 slidably, and a drawer rail assembly 643 configured to support the upper drawer 41 from among the plurality of drawers 41 and 46 to be slidable. The lower drawer 46 may be slidable due to a front roller 48 supported on the door rail assembly 80 and a rear roller 49 supported on a guide rib 90.

The drawer rail assembly 643 that supports the upper drawer 41 slidably may have the same configuration as that of the door rail assembly 80. That is, the drawer rail assembly 643 may include a fixed rail fixed to the body 10, a moving rail fixed to the upper drawer 41 and being slidable with respect to the fixed rail, and an intermediate rail disposed between the fixed rail and the moving rail, and a bearing member may be provided between the fixed rail and the moving rail so as to reduce frictional force and to operate the fixed rail and the moving rail smoothly.

The refrigerator 601 may include an automatic closing device 690 that enables the upper drawer 41 not to be moved but to be kept in place when the lower drawer 46 is selected by the selective drawing device 50 and the freezer compartment door 30 and the lower drawer 46 are drawn together. The automatic closing device 690 may have the same configuration as that of the automatic closing device according to the above-described embodiment and may interact with a hanging protrusion 689 fixed to the body 10.

Figure 25:
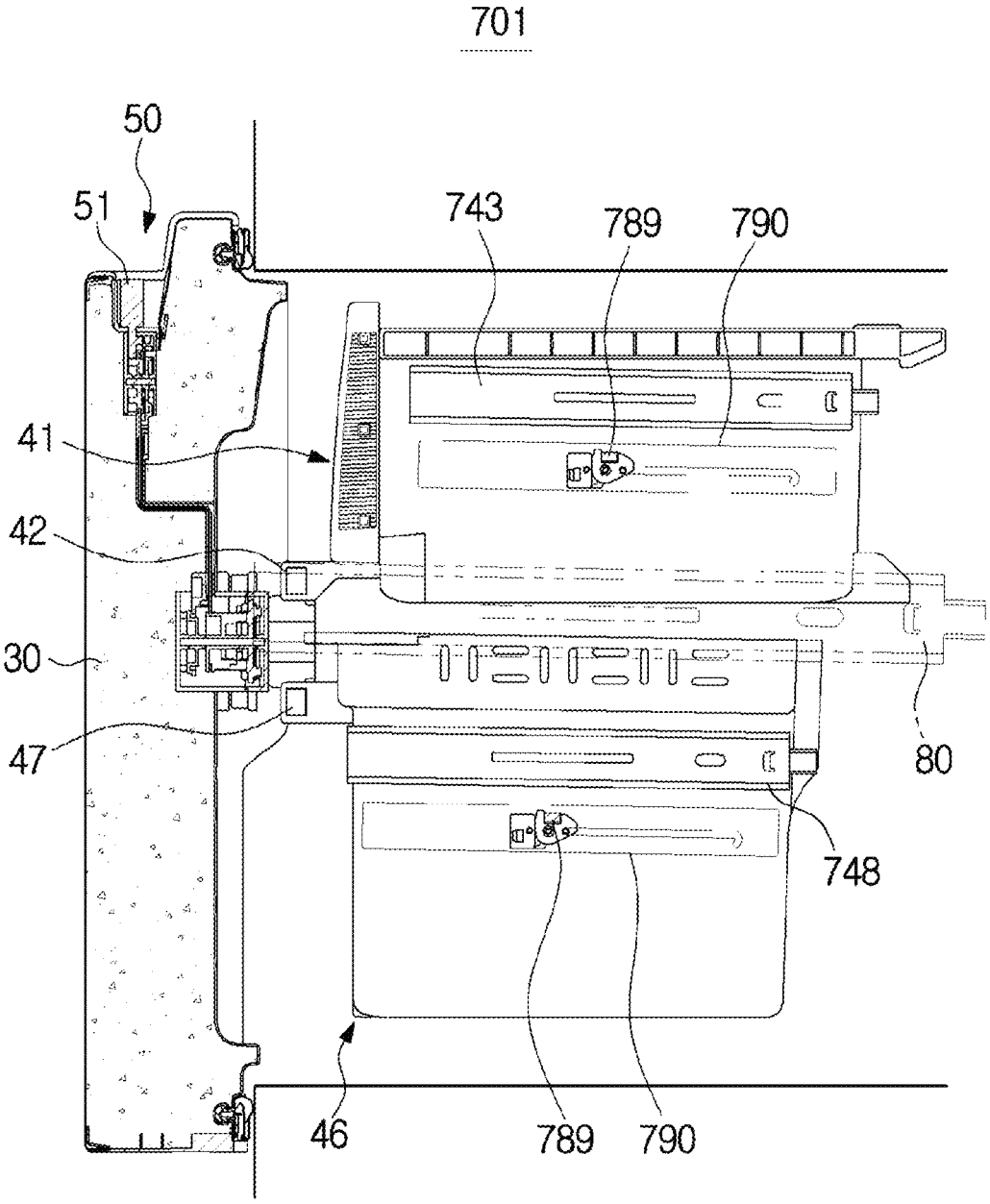
FIGS. 25 through 27 are views of a drawer supporting structure according to another embodiment of the present disclosure. In detail.
Figure 26:
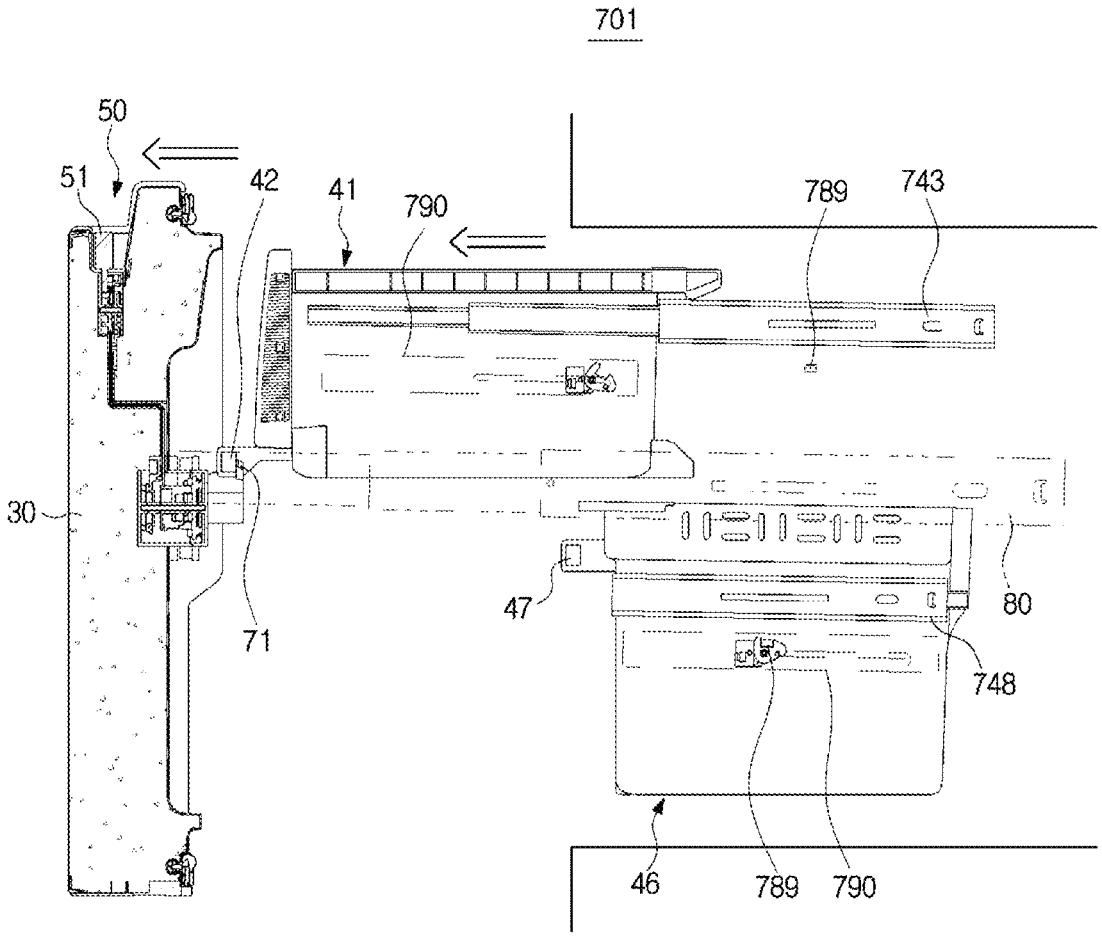
Figure 27:
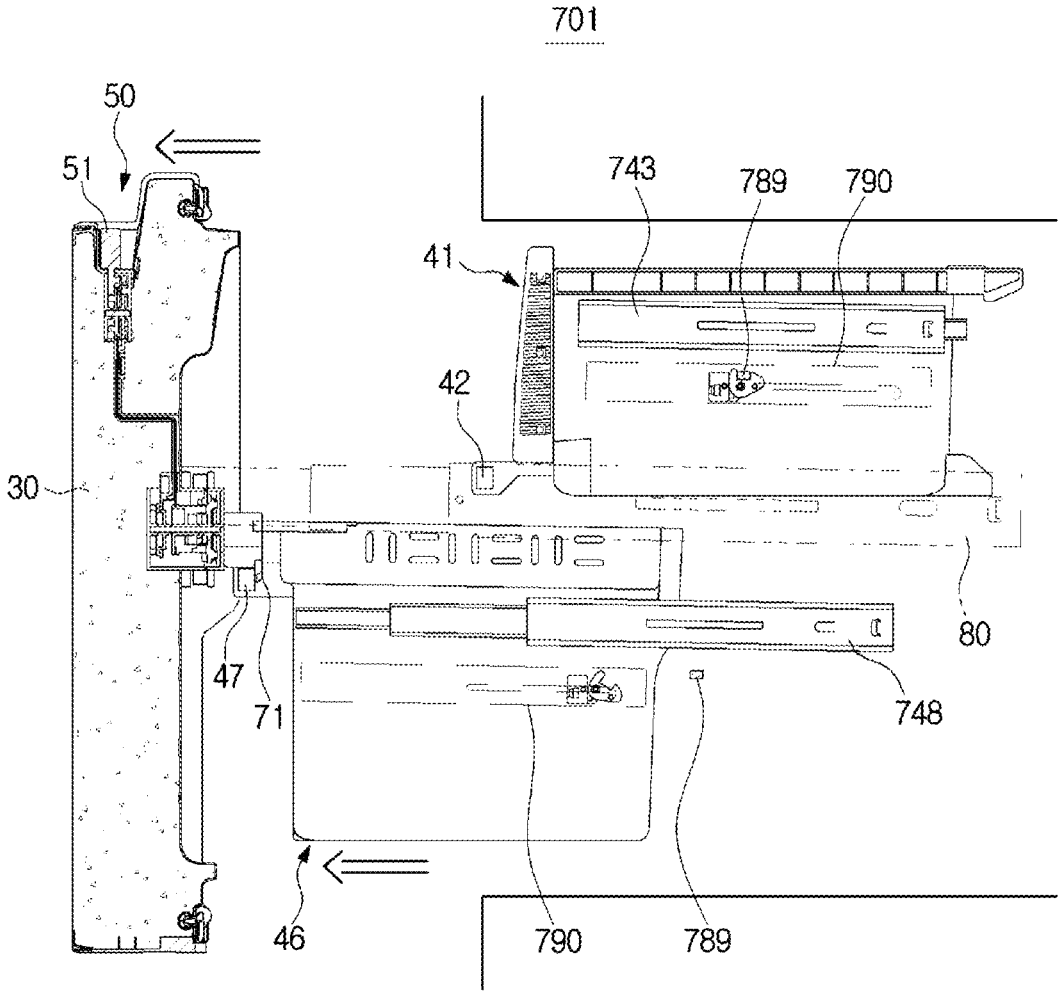

FIGS. 25 through 27 are views of a drawer supporting structure according to another embodiment of the present disclosure. In detail, FIG. 25 illustrates a state in which a door is closed, and FIG. 26 illustrates a state in which an upper drawer is drawn together when the door is drawn, and FIG. 27 illustrates a state in which a lower drawer is drawn together when the door is drawn.

The drawer supporting structure according to another embodiment of the present disclosure will be described with reference to FIGS. 25 through 27. Like reference numerals are used for like elements as those of the above-described embodiments, and descriptions thereof will be omitted.

Unlike in the above-described embodiments, a rail assembly may be used in all of a freezer compartment door 30, an upper drawer 41, and a lower drawer 46.

That is, a refrigerator 701 may include a plurality of drawers 41 and 46 provided inside a storage compartment to be slidable, a freezer compartment door 30 configured to open/close the storage compartment slidably, a door rail assembly 80 configured to support the freezer compartment door 30 slidably, an upper drawer rail assembly 743 configured to support the upper drawer 41 slidably, and a lower drawer rail assembly 748 configured to support the lower drawer 46 slidably.

An automatic closing device 790 may be provided in each of the drawers 41 and 46 to enable the drawers 41 and 46 not to be drawn but to be kept in place when the drawers 41 and 46 are not selected by the selective drawing device 50. The automatic closing device 790 may interact with a hanging protrusion 789 fixed to the body 10.

As is apparent from the above description, a drawer to be used can be selected from among a plurality of drawers when a door is drawn, so that the drawer and the door can be drawn together. Thus, convenience can be improved, and drawers not needed are not drawn so that leakage of cold air can be minimized.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body;

a storage compartment formed inside the body;

a door provided to open and close the storage compartment;

a plurality of baskets provided inside the storage compartment; and a selective drawing device configured to connect a basket selected by a user among the plurality of baskets to the door so that the selected basket is drawn together with the door, wherein the selective drawing device comprises:

a switch configured to select a basket to be drawn from among the plurality of baskets;

a selector configured to connect the selected basket from among the plurality of baskets, according to manipulation of the switch, to the door; and a power transmission unit configured to transmit manipulation force of the switch to the selector.

2. The refrigerator according to claim 1, wherein the power transmission unit comprises:

an intermediate rotation body that rotates according to a rectilinear motion of the switch;

a connection rod configured to connect the intermediate rotation body to the selector in a manner to rotate the selector according to rotation of the intermediate rotation body;

a lever member being rotatable around a rotation shaft in a manner to rotate the intermediate rotation body according to a rectilinear motion of the switch; and a slide member that makes a rectilinear motion according to a rotational motion of the lever member.

3. A refrigerator comprising:

a body;

a storage compartment formed inside the body;

a door provided to open and close the storage compartment;

a plurality of baskets provided inside the storage compartment;

a selective drawing device configured to connect a basket selected by a user among the plurality of baskets to the door so that the selected basket is drawn together with the door;

a door rail assembly configured to support the door slidably; and a first drawer rail assembly configured to support the selected basket from among the plurality of baskets slidably.

4. The refrigerator according to claim 3, further comprising a roller provided at another basket from among the plurality of baskets and supported on the door rail assembly.

5. The refrigerator according to claim 3, further comprising a second drawer rail assembly configured to support another basket from among the plurality of baskets slidably.

6. A refrigerator comprising:

a body;

a storage compartment formed inside the body;

a drawer provided inside the storage compartment;

a door slidably provided to open and close the storage compartment;

a door rail assembly configured to support the door slidably; and a guide rib provided in sidewalls of the body to guide movement of the drawer, wherein the drawer comprises:

a front roller supported on the door rail assembly, and a rear roller supported on the guide rib, and a selective drawing device configured to:

connect the door to the drawer in a manner to draw the drawer together with the door when the door is drawn, and separate the door from the drawer so that only the door is drawn.

7. The refrigerator according to claim 6, wherein the door rail assembly comprises:

a fixed rail fixed to the body and a moving rail, and the moving rail fixed to the door and being slidable with respect to the fixed rail and comprises a roller support configured to support the front roller.

8. The refrigerator according to claim 6, wherein the guide rib comprises a stopper configured to keep a position of the drawer when the door is drawn in a state in which the door and the drawer are separated from each other.

* * * * *